US007588662B2

(12) United States Patent
Lang et al.

(10) Patent No.: US 7,588,662 B2
(45) **Date of Patent: *Sep. 15, 2009**

(54) TISSUE PRODUCTS CONTAINING NON-FIBROUS POLYMERIC SURFACE STRUCTURES AND A TOPICALLY-APPLIED SOFTENING COMPOSITION

(75) Inventors: Frederick John Lang, Neenah, WI (US); Perry Howard Clough, Neenah, WI (US); Thomas Joseph Dyer, Neenah, WI (US); Mike Thomas Goulet, Neenah, WI (US); Kou-Chang Liu, Appleton, WI (US); Michael Ralph Lostocco, Appleton, WI (US); Deborah Joy Nickel, Appleton, WI (US); Michael John Rekoske, Appleton, WI (US); Troy Michael Runge, Neenah, WI (US); Michelle Lynn Seabaugh, Appleton, WI (US); Jeffrey James Timm, Menasha, WI (US); Kenneth J. Zwick, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 245 days.

This patent is subject to a terminal disclaimer.

(21) Appl. No.: 11/726,586

(22) Filed: Mar. 22, 2007

(65) Prior Publication Data

US 2008/0230195 A1 Sep. 25, 2008

(51) Int. Cl.
*D21H 21/16* (2006.01)
*D21H 21/22* (2006.01)

(52) U.S. Cl. ..... 162/134; 162/158; 162/184; 162/168.1; 424/402; 424/414; 428/195.1

(58) Field of Classification Search ..... 162/109, 162/134–135, 158, 183–184; 428/320.2, 428/321.5, 411.1, 537.5, 195.1; 424/400–402, 424/443, 488, 414; 252/8.63; 427/358, 361, 427/391

See application file for complete search history.

(56) References Cited

U.S. PATENT DOCUMENTS 3,338,992 A 8/1967 Kinney
3,341,394 A 9/1967 Kinney
3,502,538 A 3/1970 Petersen
3,502,763 A 3/1970 Hartmann
3,542,615 A 11/1970 Dobo et al.
3,556,932 A 1/1971 Coscia et al.
3,556,933 A 1/1971 Williams et al.
3,575,173 A 4/1971 Loyer
3,585,104 A 6/1971 Kleinert
3,645,992 A 2/1972 Elston
3,669,822 A 6/1972 Cowen
3,692,618 A 9/1972 Dorschner et al.
3,700,623 A 10/1972 Keim
3,772,076 A 11/1973 Keim
3,802,817 A 4/1974 Matsuki et al.
3,849,241 A 11/1974 Butin et al.
3,855,158 A 12/1974 Petrovich et al.
3,879,257 A 4/1975 Gentile et al.
3,899,388 A 8/1975 Petrovich et al.
4,076,698 A 2/1978 Anderson et al.
4,100,324 A 7/1978 Anderson et al.
4,129,528 A 12/1978 Petrovich et al.
4,147,586 A 4/1979 Petrovich et al.
4,222,921 A 9/1980 Van Eenam
4,309,510 A 1/1982 Kleber
4,326,000 A 4/1982 Roberts, Jr.
4,340,563 A 7/1982 Appel et al.
4,355,066 A 10/1982 Newman
4,375,448 A 3/1983 Appel et al.
4,440,898 A 4/1984 Pomplun et al.
4,494,278 A 1/1985 Kroyer et al.
4,514,345 A 4/1985 Johnson et al.
4,528,239 A 7/1985 Trokhan (Continued)

FOREIGN PATENT DOCUMENTS

DE 197 11 452 A1 9/1998

(Continued)

OTHER PUBLICATIONS

American Society for Testing Materials (ASTM) Designation: D 792-98, "Standard Test Methods for Density and Specific Gravity (Relative Density) of Plastics by Displacement," pp. 159-163, published Nov. 1998.

(Continued)

*Primary Examiner*—José A Fortuna
(74) *Attorney, Agent, or Firm*—Gregory E. Croft

(57) ABSTRACT

Soft tissue products with a good rate of absorbency, such as facial and bath tissue, are provided by forming a tissue sheet with a non-fibrous polymeric surface structure and thereafter topically applying a softening composition comprising a polysiloxane, a fatty alkyl derivative and glycerin. The non-fibrous polymeric surface structure is created by applying an additive composition to the surface of a tissue sheet prior to or after drying. The additive composition can be an aqueous dispersion containing an alpha-olefin polymer, an ethylene-carboxylic acid copolymer, or mixtures thereof. The alpha-olefin polymer may comprise an interpolymer of ethylene and octene, while the ethylene-carboxylic acid copolymer may comprise ethylene-acrylic acid copolymer.

8 Claims, 7 Drawing Sheets

U.S. PATENT DOCUMENTS

| | | | | |
|---|---|---|---|---|
| 4,574,021 | A | 3/1986 | Endres et al. | |
| 4,594,130 | A | 6/1986 | Chang et al. | |
| 4,599,392 | A | 7/1986 | McKinney et al. | |
| 4,640,810 | A | 2/1987 | Laursen et al. | |
| 4,793,898 | A | 12/1988 | Laamanen et al. | |
| 4,818,464 | A | 4/1989 | Lau | |
| 4,837,070 | A | 6/1989 | Weber et al. | |
| 4,950,545 | A | 8/1990 | Walter et al. | |
| 4,975,320 | A | 12/1990 | Goldstein et al. | |
| 4,988,781 | A | 1/1991 | McKinney et al. | |
| 5,008,344 | A | 4/1991 | Bjorkquist | |
| 5,085,736 | A | 2/1992 | Bjorkquist | |
| 5,098,522 | A | 3/1992 | Smurkoski et al. | |
| 5,104,923 | A | 4/1992 | Steinwand et al. | |
| 5,109,063 | A | 4/1992 | Cheng et al. | |
| 5,129,988 | A | 7/1992 | Farrington, Jr. | |
| 5,160,484 | A | 11/1992 | Nikoloff | |
| 5,227,242 | A | 7/1993 | Walter et al. | |
| 5,260,171 | A | 11/1993 | Smurkoski et al. | |
| 5,272,236 | A | 12/1993 | Lai et al. | |
| 5,275,700 | A | 1/1994 | Trokhan | |
| 5,278,272 | A | 1/1994 | Lai et al. | |
| 5,328,565 | A | 7/1994 | Rasch et al. | |
| 5,334,289 | A | 8/1994 | Trokhan et al. | |
| 5,372,236 | A | 12/1994 | Layer | |
| 5,382,400 | A | 1/1995 | Pike et al. | |
| 5,384,373 | A | 1/1995 | McKinney et al. | |
| 5,385,643 | A | 1/1995 | Ampulski | |
| 5,389,202 | A | 2/1995 | Everhart et al. | |
| 5,389,204 | A | 2/1995 | Ampulski | |
| 5,429,686 | A | 7/1995 | Chiu et al. | |
| 5,431,786 | A | 7/1995 | Rasch et al. | |
| 5,432,000 | A | 7/1995 | Young, Sr. et al. | |
| 5,496,624 | A | 3/1996 | Stelljes, Jr. et al. | |
| 5,500,277 | A | 3/1996 | Trokhan et al. | |
| 5,514,523 | A | 5/1996 | Trokhan et al. | |
| 5,518,585 | A | 5/1996 | Huth et al. | |
| 5,527,171 | A | 6/1996 | Soerensen | |
| 5,529,665 | A | 6/1996 | Kaun | |
| 5,543,215 | A | 8/1996 | Hansen et al. | |
| 5,554,467 | A | 9/1996 | Trokhan et al. | |
| 5,558,873 | A | 9/1996 | Funk et al. | |
| 5,566,724 | A | 10/1996 | Trokhan et al. | |
| 5,573,637 | A | 11/1996 | Ampulski et al. | |
| 5,595,628 | A | 1/1997 | Gordon et al. | |
| 5,624,790 | A | 4/1997 | Trokhan et al. | |
| 5,628,876 | A | 5/1997 | Ayers et al. | |
| 5,656,132 | A | 8/1997 | Farrington, Jr. et al. | |
| 5,672,248 | A | 9/1997 | Wendt et al. | |
| 5,677,383 | A | 10/1997 | Chum et al. | |
| 5,753,245 | A * | 5/1998 | Fowler et al. | 424/401 |
| 5,830,320 | A | 11/1998 | Park et al. | |
| 5,844,045 | A | 12/1998 | Kolthammer et al. | |
| 5,869,575 | A | 2/1999 | Kolthammer et al. | |
| 5,871,763 | A | 2/1999 | Luu et al. | |
| 5,885,697 | A | 3/1999 | Krzysik et al. | |
| 5,935,384 | A | 8/1999 | Taniguchi | |
| 6,033,761 | A | 3/2000 | Dwiggins et al. | |
| 6,054,020 | A | 4/2000 | Goulet et al. | |
| 6,096,152 | A | 8/2000 | Anderson et al. | |
| 6,096,169 | A | 8/2000 | Hermans et al. | |
| 6,111,023 | A | 8/2000 | Chum et al. | |
| 6,120,642 | A | 9/2000 | Lindsay et al. | |
| 6,129,815 | A | 10/2000 | Larson et al. | |
| 6,143,135 | A | 11/2000 | Hada et al. | |
| 6,171,441 | B1 | 1/2001 | Phillips et al. | |
| 6,194,517 | B1 | 2/2001 | Pomplun et al. | |
| 6,197,154 | B1 | 3/2001 | Chen et al. | |
| 6,224,714 | B1 | 5/2001 | Schroeder et al. | |
| 6,231,719 | B1 | 5/2001 | Garvey et al. | |
| 6,274,667 | B1 | 8/2001 | Shannon et al. | |
| 6,287,418 | B1 | 9/2001 | Schroeder et al. | |
| 6,291,372 | B1 | 9/2001 | Mumick et al. | |
| 6,306,408 | B1 | 10/2001 | Eichhorn et al. | |
| 6,316,549 | B1 | 11/2001 | Chum et al. | |
| 6,361,784 | B1 | 3/2002 | Brennan et al. | |
| 6,365,667 | B1 | 4/2002 | Shannon et al. | |
| 6,379,498 | B1 | 4/2002 | Burns et al. | |
| 6,413,529 | B1 * | 7/2002 | Beerse et al. | 424/402 |
| 6,423,270 | B1 | 7/2002 | Wall | |
| 6,432,270 | B1 | 8/2002 | Liu et al. | |
| 6,447,643 | B2 | 9/2002 | Fingal et al. | |
| 6,448,341 | B1 | 9/2002 | Kolthammer et al. | |
| 6,511,580 | B1 | 1/2003 | Liu | |
| 6,514,383 | B1 | 2/2003 | Liu et al. | |
| 6,538,070 | B1 | 3/2003 | Cardwell et al. | |
| 6,566,446 | B1 | 5/2003 | Parikh et al. | |
| 6,570,054 | B1 | 5/2003 | Gatto et al. | |
| 6,576,087 | B1 | 6/2003 | Liu | |
| 6,582,558 | B1 | 6/2003 | Liu | |
| 6,599,393 | B1 | 7/2003 | Liu | |
| 6,599,394 | B1 | 7/2003 | Liu et al. | |
| 6,607,637 | B1 | 8/2003 | Vinson et al. | |
| 6,617,490 | B1 | 9/2003 | Chen et al. | |
| 6,641,822 | B2 * | 11/2003 | Eichhorn et al. | 424/401 |
| 6,716,203 | B2 | 4/2004 | Sorebo et al. | |
| 6,860,967 | B2 | 3/2005 | Baumoller et al. | |
| 6,908,966 | B2 | 6/2005 | Chang et al. | |
| 6,913,673 | B2 | 7/2005 | Baggot et al. | |
| 6,949,168 | B2 | 9/2005 | Liu et al. | |
| 6,951,598 | B2 | 10/2005 | Flugge et al. | |
| 6,964,726 | B2 | 11/2005 | Chen et al. | |
| 6,977,026 | B2 | 12/2005 | Liu et al. | |
| 6,991,706 | B2 | 1/2006 | Lindsay et al. | |
| 6,994,865 | B2 | 2/2006 | Branham et al. | |
| 7,101,460 | B2 | 9/2006 | Liu et al. | |
| 7,166,292 | B2 * | 1/2007 | Isele et al. | 424/402 |
| 7,186,318 | B2 | 3/2007 | Liu et al. | |
| 7,195,771 | B1 * | 3/2007 | Hsu et al. | 424/402 |
| 2002/0086039 | A1 * | 7/2002 | Lee et al. | 424/401 |
| 2002/0115744 | A1 | 8/2002 | Svenningsen et al. | |
| 2002/0162243 | A1 | 11/2002 | Runge et al. | |
| 2002/0165508 | A1 * | 11/2002 | Klofta et al. | 604/364 |
| 2003/0027470 | A1 | 2/2003 | Chang et al. | |
| 2003/0072950 | A1 | 4/2003 | Rodrigues et al. | |
| 2003/0121627 | A1 | 7/2003 | Hu et al. | |
| 2004/0020114 | A1 | 2/2004 | Boehmer et al. | |
| 2004/0074622 | A1 * | 4/2004 | Liu et al. | 162/179 |
| 2004/0084165 | A1 | 5/2004 | Shannon et al. | |
| 2004/0099388 | A1 * | 5/2004 | Chen et al. | 162/134 |
| 2004/0099389 | A1 | 5/2004 | Chen et al. | |
| 2004/0118540 | A1 | 6/2004 | Garnier et al. | |
| 2004/0191486 | A1 | 9/2004 | Underhill et al. | |
| 2004/0209539 | A1 | 10/2004 | Confalone et al. | |
| 2004/0234804 | A1 | 11/2004 | Liu et al. | |
| 2005/0031847 | A1 * | 2/2005 | Martens et al. | 428/321.5 |
| 2005/0045294 | A1 | 3/2005 | Goulet et al. | |
| 2005/0045295 | A1 | 3/2005 | Goulet et al. | |
| 2005/0058693 | A1 | 3/2005 | Joseph et al. | |
| 2005/0058833 | A1 | 3/2005 | Krzysik et al. | |
| 2005/0100754 | A1 | 5/2005 | Moncla et al. | |
| 2005/0101927 | A1 * | 5/2005 | Joseph et al. | 604/367 |
| 2005/0118435 | A1 | 6/2005 | Delucia et al. | |
| 2005/0124753 | A1 | 6/2005 | Ashihara et al. | |
| 2005/0136265 | A1 * | 6/2005 | Liu et al. | 428/447 |
| 2005/0136766 | A1 | 6/2005 | Tanner et al. | |
| 2005/0148257 | A1 | 7/2005 | Hermans et al. | |
| 2005/0192365 | A1 | 9/2005 | Strandburg et al. | |
| 2005/0214335 | A1 | 9/2005 | Allen et al. | |
| 2005/0224200 | A1 | 10/2005 | Bouchard et al. | |
| 2006/0014884 | A1 | 1/2006 | Goulet et al. | |
| 2006/0070712 | A1 | 4/2006 | Runge et al. | |
| 2006/0085998 | A1 | 4/2006 | Herman et al. | |
| 2006/0086472 | A1 | 4/2006 | Hermans et al. | |

| | | | | |
|---|---|---|---|---|
| 2006/0130989 | A1 | 6/2006 | Liu et al. | |
| 2007/0020315 | A1 | 1/2007 | Shannon et al. | |
| 2007/0083018 | A1 * | 4/2007 | Liu et al. | 525/477 |
| 2007/0131366 | A1 * | 6/2007 | Underhill et al. | 162/109 |
| 2007/0137808 | A1 | 6/2007 | Lostocco et al. | |
| 2007/0137809 | A1 | 6/2007 | Dyer et al. | |
| 2007/0137810 | A1 * | 6/2007 | Dyer et al. | 162/109 |
| 2007/0137811 | A1 | 6/2007 | Runge et al. | |
| 2007/0137813 | A1 | 6/2007 | Nickel et al. | |
| 2007/0141936 | A1 | 6/2007 | Bunyard et al. | |
| 2007/0144697 | A1 * | 6/2007 | Dyer et al. | 162/158 |
| 2007/0246180 | A1 | 10/2007 | Liu | |
| 2007/0284069 | A1 * | 12/2007 | Dyer et al. | 162/112 |
| 2007/0295464 | A1 | 12/2007 | Fetner et al. | |
| 2008/0000598 | A1 | 1/2008 | Dyer et al. | |
| 2008/0000602 | A1 | 1/2008 | Dyer et al. | |
| 2008/0041543 | A1 | 2/2008 | Dyer et al. | |
| 2008/0073045 | A1 | 3/2008 | Dyer et al. | |
| 2008/0073046 | A1 | 3/2008 | Dyer et al. | |
| 2008/0099168 | A1 | 5/2008 | Liu | |
| 2008/0135195 | A1 | 6/2008 | Hermans et al. | |
| 2008/0230195 | A1 * | 9/2008 | Lang et al. | 162/168.6 |
| 2008/0230196 | A1 * | 9/2008 | Liu | 162/179 |

FOREIGN PATENT DOCUMENTS

| | | | |
|---|---|---|---|
| DE | 198 58 616 | A1 | 6/2000 |
| EP | 0 608 460 | A1 | 8/1994 |
| EP | 0 620 256 | A2 | 10/1994 |
| EP | 0 857 453 | B1 | 8/1998 |
| EP | 1250940 | A1 * | 10/2002 |
| EP | 1 344 511 | A2 | 9/2003 |
| EP | 0 926 288 | B1 | 10/2003 |
| GB | 142441 | A | 3/1921 |
| GB | 2 246 373 | | 1/1992 |
| WO | WO 95/01479 | A1 | 1/1995 |
| WO | WO 96/08601 | A1 | 3/1996 |
| WO | WO 98/29605 | A1 | 7/1998 |
| WO | WO 99/34057 | A1 | 7/1999 |
| WO | WO 00/66835 | A1 | 11/2000 |
| WO | WO 02/48458 | A1 | 6/2002 |
| WO | WO 03/040442 | A1 | 5/2003 |
| WO | WO 03/044270 | A2 * | 5/2003 |
| WO | WO 03/057988 | A1 * | 7/2003 |
| WO | WO 2005/021622 | A2 | 3/2005 |
| WO | WO 2005/021638 | A2 | 3/2005 |
| WO | WO 2005/031068 | A1 | 4/2005 |
| WO | WO 2005/080677 | A2 | 9/2005 |
| WO | WO 2007/070129 | A1 | 6/2007 |
| WO | WO 2007/070145 | A1 | 6/2007 |
| WO | WO 2007/070153 | A1 | 6/2007 |
| WO | WO 2007/075356 | A2 | 7/2007 |
| WO | WO 2007/078342 | A1 | 7/2007 |
| WO | WO 2007/078499 | A1 | 7/2007 |
| WO | WO 2008/068652 | A2 | 6/2008 |
| WO | WO 2008114154 | A1 * | 9/2008 |
| WO | WO 2008114155 | A1 * | 9/2008 |

OTHER PUBLICATIONS

American Society for Testing Materials (ASTM) Designation: D1238-04c, "Standard Test Method for Melt Flow Rates of Thermoplastics by Extrusion Plastometer," pp. 1-14, published Dec. 2004.

TAPPI Official Test Method T 402 om-93, "Standard Conditioning and Testing Atmospheres For Paper, Board, Pulp Handsheets, and Related Products," published by the TAPPI Press, Atlanta, Georgia, revised 1993, pp. 1-3.

TAPPI Official Test Method T 410 om-98, "Grammage of Paper and Paperboard (Weight Per Unit Area)," published by the TAPPI Press, Atlanta, Georgia, revised 1998, pp. 1-5.

TAPPI Official Test Method T 411 om-89, "Thickness (Caliper) of Paper, Paperboard, and Combined Board," published by the TAPPI Press, Atlanta, Georgia, revised 1989, pp. 1-3.

TAPPI Official Test Method T 530 om-02, "Size Test for Paper By Ink Resistance (Hercules-Type Method)," published by the TAPPI Press, Atlanta, Georgia, revised 2002, pp. 1-9.

"Affinity EG 8200—Polyolefin Plastomer for General Plastomeric Applications," Product Information sheet, The Dow Chemical Company, Jul. 2001, 2 pages.

Chou, Chai-jing et al., "Polymer Nanocomposite," The Dow Chemical Company, 2002, 5 pages.

"Engage" Polyolefin Elastomer, Material Safety Data Sheet, DuPont Dow Elastomers L.L.C., Wilmington, Delaware, Mar. 29, 1999, pp. 1-7.

* cited by examiner

Control Sample at 500x magnification.

2.5% add-on of the additive composition at 500x magnification.

5% add-on of the additive composition at 500x magnification.

10% add-on of the additive composition at 500x magnification.

Cross-Section of the 2.5% add-on sample.

TISSUE PRODUCTS CONTAINING NON-FIBROUS POLYMERIC SURFACE STRUCTURES AND A TOPICALLY-APPLIED SOFTENING COMPOSITION

BACKGROUND OF THE INVENTION

Absorbent tissue products such as paper towels, facial tissues, bath tissues and other similar products are designed to include several important properties. In particular, such products should have good softness, strength and a high rate of absorbency. Unfortunately, it is very difficult to produce a high strength tissue product that is also soft and highly absorbent. Usually, when steps are taken to increase one property of the product, other characteristics of the product are adversely affected. Consequently, there is always a need to provide tissue products with improved softness while maintaining other functional properties.

SUMMARY OF THE INVENTION

It has now been discovered that soft tissue products with a good absorbent rate can be made by providing a tissue sheet with non-fibrous polymeric surface structures and thereafter topically applying a softening composition. The softening composition can comprise one or more of polysiloxane, fatty alkyl derivatives and glycerin (hereinafter referred to as "actives").

Hence in one aspect, the invention resides in a tissue sheet containing non-fibrous polymeric surface structures (hereinafter described) and a topically-applied softening composition, said softening composition comprising, based on the amount of actives in the composition, from about 5 to about 40 weight percent polysiloxane, from about 10 to about 50 weight percent of a fatty alkyl derivative, from about 20 to about 80 weight percent glycerin and from 0 to about 10 weight percent formulation aids and/or skin beneficial agents.

The amount of the softening composition actives in the tissue can be, based on the dry weight of the tissue, from about 0.2 to about 20 weight percent, more specifically from about 0.2 to about 10 weight percent, more specifically from about 0.5 to about 5 weight percent and still more specifically from about 1 to about 3 weight percent.

As used herein, the term "dry" weight percent in reference to a composition or tissue sheet containing a composition means that the amount of free water or other volatile components in the composition or tissue product are ignored. Stated differently, the "dry" weight percent is intended to represent the amount of "active components" in the composition. Therefore, for tissue sheets, all recited dry weight percent amounts refer to tissue sheets that have been aged for at least three (3) weeks and therefore have equilibrated with ambient conditions. The dry weight percent amounts can be determined by chemical extraction and analysis of the extract or, if the conditioned basis weight of the tissue sheet prior to treatment is known, by subtracting the conditioned basis weight of the untreated tissue from the conditioned basis weight of the treated tissue and dividing the difference by the conditioned basis weight of the treated tissue and multiplying by 100.

The softening composition can be applied to the tissue sheet in the form of a neat blend, an aqueous solution or an aqueous emulsion. When applied as an aqueous solution or an aqueous emulsion, the concentration of the softening composition in the aqueous solution or aqueous emulsion can be from about 35 to about 80 weight percent, more specifically from about 40 to about 70 weight percent and still more specifically from about 45 to about 70 weight percent. Suitable methods of applying the softening composition to the sheet, either directly or indirectly, include printing or spraying.

The amount of polysiloxane in the softening composition, based on the total amount of actives in the composition, can be from about 5 to about 40 weight percent, more specifically from about 5 to about 30 weight percent, more specifically from about 5 to about 20 weight percent and still more specifically from about 5 to about 10 weight percent.

Polysiloxanes useful for purposes of this invention can have one or more pendant functional groups such as amine, quaternium, aldehyde, epoxy, hydroxy, alkoxyl, polyether and carboxylic acid and its derivatives, such as amides and esters. Particularly suitable polysiloxanes have the following general structure:

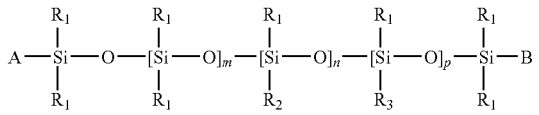

wherein:

"m" is from 10 to 100,000;

"n" is from 1 to 10,000;

"p" is from 0 to 1,000;

"A" and "B" are independently a hydroxyl, $C_1$ to $C_{20}$ or $R_2$;

$R_1$, $R_2$ and $R_3$ are distributed in random or block fashion;

$R_1$ is a $C_1$ to $C_8$ radical, which can be straight chain, branched or cyclic;

$R_2$ is a $C_1$ to $C_8$ radical, which can be straight chain, branched or cyclic, or of the structure:

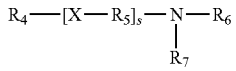

wherein $R_4$ and $R_5$ are independently a $C_2$ to $C_8$ alkylene diradical, which can be straight chain or branched, substituted, or unsubstituted;

X is an oxygen or N—$R_8$;

$R_6$, $R_7$ and $R_8$ are independently hydrogen, a substituted or unsubstituted $C_1$ or $C_2$, a substituted or unsubstituted straight chain or branched or cyclic $C_3$ to $C_{20}$ alky radical, or an acyl radical, such as an acetyl radical; and "s" is 0 or 1;

$R_3$ is of the structure: $R_9$—Y—$[C_2H_4O]_r$—$[C_3H_6O]_q$—$R_{10}$ wherein

Y is an oxygen or N—$R_{11}$;

$R_9$ is a $C_2$ to $C_8$ alkylene diradical, which can be straight chain or branched, substituted or unsubstituted;

$R_{10}$ and $R_{11}$ are independently hydrogen, a substituted or unsubstituted $C_1$ or $C_2$, a substituted or unsubstituted, straight chain or branched or cyclic $C_3$ to $C_{20}$ alkyl radical;

"r" is from 1 to 100,000; and

"q" is from 0 to 100,000.

When $R_2$=$R_1$, "A" and "B" can also be a nitrogen quarternium.

Examples of suitable commercially available polysiloxanes include AF-2340, AF-2130, AF-23, HAF-1130, EAF-3000, EAF-340, EAF-15, AF-2740, WR-1100, WR-1300 and Wetsoft CTW from Kelmar/Wacker; DC-8822, DC-8566, DC-8211, DC-SF8417, DC-2-8630, DC-NSF, DC-8413, DC-SSF, DC-8166 from Dow Corning; SF-69, SF-99 SF-1023 from GE Silicones and Tegopren 6924, Tegopren 7990, Tego IS4111 from Goldschmidt/Degussa.

The amount of fatty alkyl derivative in the softening composition can be, based on the total amount of actives in the composition, from about 10 to about 50 weight percent, more specifically from about 20 to about 50 weight percent and still more specifically from about 30 to about 50 weight percent.

Fatty alkyl derivatives particularly suitable for purposes of this invention can have the following general structure:

$$R_{14}—G$$

wherein:

$R_{14}$ is a $C_8$ to $C_{40}$ alkyl radical, which can be substituted or unsubstituted, primary, secondary or tertiary; straight chain, branched or cyclic; and "G" is hydroxy, amine, sulfonate, sulfate, phosphate, acid or acid derivative, or $—Q—[C_2H_4O]_i—[C_3H_6O]_j—[C_tH_{2t}O]_v—R_{13}$ radical;

wherein

"Q" is an oxygen radical, an NH radical or $N—[C_2H_4O\}_i—[C_3H_6O]_j—[C_tH_{2t}O]_v—R_{13}$ radical;

$R_{13}$ is a hydrogen, a substituted or unsubstituted $C_1$ to $C_6$ alkyl radical, a straight chain or branched $C_1$ to $C_6$ alkyl radical, or a cyclic $C_1$ to $C_6$ alkyl radical;

"i", "j" and "v" are independently from 0 to 100,000, where the oxide moieties are distributed along the polymer backbone randomly or as blocks;

"i+j+v" is equal to or greater than 10; and

"t" is from 4 to 10.

Examples of commercially available suitable fatty alkyl derivatives are 9-EO ethoxylated tridecylalcohol, Ceteth-10, Ceteth-12 (12-EO ethoxylated cetyl alcohol) and Ceteth-20. More particularly, suitable commercially available fatty alkyl derivatives include Pluraface A-38, Macol CSA 20 and Macol LA 12 from BASF; Armeen 16D, Armeen 18D, Armeen HTD, Armeen 2C, Armeen M2HT, Armeen 380, Ethomeen 18/15 Amid 0, Witconate 90, Witconate AOK, and Witcolate C from Akzo Nobel and Tergitol 15-S-9, Tergitol 15-S-7, Tergitol 15-S-12, Tergitol TMN-6, Tergitol TMN-10, Tergitol XH, Tergitol XDLW, and Tergitol RW-50 from Dow Chemical.

The amount of glycerin in the softening composition can be, based on the total amount of actives in the composition, from about 20 to about 80 weight percent, more specifically from about 25 to about 80 weight percent, more specifically from about 30 to about 80 weight percent, and still more specifically from about 40 to about 70 weight percent.

Suitable formulation aids include, without limitation, emulsifiers, co-solvent, anti-foaming agents and preservatives. Suitable skin beneficial agents include, without limitation, aloe, vitamin-E, chamomile and α-hydroxy acids.

As used herein, a "non-fibrous polymeric surface structure" includes any kind of topically-applied discontinuous polymeric structure residing solely on or near the surface of the fibrous tissue structure and which can be visually detected by photomicrographs using 500× magnification. Advantageously, such non-fibrous polymeric surface structures are fragmented film materials, platelets or other irregularly-shaped deposits that result from the deposition of a film-forming polymer onto the surface of the tissue sheet. The discontinuous non-fibrous polymeric surface structures can be interconnected or isolated, or a combination of interconnected surface structures and isolated structures. The non-fibrous surface structures provide a soft lubricious feel to the tissue because they are present on the surface, but they also allow the tissue to absorb fluids because they are discontinuous, thereby leaving open or untreated areas in or on the surface of the tissue. As such, the tissue products of this invention exhibit good absorbent rates. In addition, the combination of the non-fibrous surface structures and the additional presence of the softening composition creates an even greater degree of softness. Furthermore, the softening composition is such that the absorbency of the tissue remains very acceptable, which is unexpected.

As will be more fully described herein, suitable methods of forming tissue sheets and the non-fibrous polymeric surface structures are described in commonly-assigned co-pending U.S. patent application Ser. No. 11/635,385 filed Dec. 7, 2006, and entitled "Additive Compositions For Treating Various Basesheets", which is hereby incorporated by reference. More particularly, the non-fibrous polymeric surface structures can be created by topically applying an "additive composition" to the surface of the tissue sheet prior to drying, during drying or after drying. The additive composition can be topically applied to one or both sides of a tissue web.

A particularly suitable method of creating the non-fibrous polymeric surface structures is to spray the additive composition onto the surface of a Yankee dryer prior to creping the dried tissue sheet. However, the additive composition can be directly applied to the web, such as by spraying, extrusion, or printing onto one or both sides of the web. When extruded onto the web, any suitable extrusion device may be used, such as a slot-coat extruder or a meltblown dye extruder. When printed onto the web, any suitable printing device may be used. The pattern may comprise, for instance, a pattern of discrete shapes, a reticulated pattern, or a combination of both. Such printing methods can include direct gravure printing using a separate gravure roll for each side, offset gravure printing using duplex printing (both sides printed simultaneously) or station-to-station printing (consecutive printing of each side in one pass). In another embodiment, a combination of offset and direct gravure printing can be used. In still another embodiment, flexographic printing using either duplex or station-to-station printing can also be utilized to apply the additive composition. In one embodiment, the additive composition may be heated prior to or during application to a tissue web. Heating the composition can lower the viscosity for facilitating application. For instance, the additive composition may be heated to a temperature of from about 50° C. to about 150° C.

When the tissue web is adhered to the creping drum, if desired, the creping drum may be heated. For instance, the creping surface may be heated to a temperature of from about 80° C. to about 200° C., such as from about 100° C. to about 150° C. The additive composition may be applied only to a single side of the tissue web or may be applied to both sides of the web according to the same or different patterns. In general, the additive composition may be applied to only one side of the web and only one side of the web may be creped, the additive composition may be applied to both sides of the web and only one side of the web is creped, or the additive composition may be applied to each side of the web and each side of the web may be creped.

The total amount of additive composition applied to each side of the web can be in the range of from about 0.5% to about 30% by weight, based upon the total weight of the web, more specifically from about 1% to about 20% by weight, more specifically from about 1% to about 10% by weight, more specifically from about 1.5% to about 5% and still more specifically from about 2% to about 4%. In some embodiments, the additive composition may be applied to the web in relatively light amounts such that the additive composition does not form an interconnected network but, instead, appears on the basesheet as treated discrete areas. Even at relatively low amounts, however, the additive composition can still enhance at least one property of the basesheet. For instance, the feel of the basesheet can be improved even in amounts of about 2.5% by weight or less, more specifically about 2% by weight or less, more specifically about 1.5% by weight or less, more specifically about 1% by weight or less, more specifically about 0.5% by weight or less and still more specifically from about 0.5 to about 2.5 weight percent. At relatively low add-on levels, the additive composition may also deposit differently onto the basesheet than when at relatively high add-on levels. For example, at relatively low add-on levels, not only do discrete treated areas form on the basesheet, but the additive composition may better follow the topography of the basesheet. For instance, in one embodiment, it has been discovered that the additive composition follows the crepe pattern of a basesheet when the basesheet is creped.

As previously mentioned, the non-fibrous polymeric surface structures are located on or near the surface of the tissue. Consequently, the additive composition does not substantially penetrate into the tissue web when applied. For instance, the additive composition penetrates the tissue web in an amount of about 30% of the thickness of the web or less, more specifically about 20% or less, more specifically about 10% or less, more specifically about 5% or less, more specifically about 3% or less and still more specifically about 1% or less. By remaining primarily on the surface of the web, the non-fibrous polymeric surface structures contribute to the soft surface feel of the tissue and, at the same time, do not interfere with the liquid absorption capacity properties of the web. Further, the presence of the non-fibrous polymeric surface structures does not substantially increase the stiffness of the web, particularly when the non-fibrous polymeric surface structures are not interconnected.

The additive composition can be applied to one or both sides of the paper web so as to cover from about 15% to about 75% of the surface area of the web (as viewed from above the web in plan view). More particularly, in most applications, the additive composition will cover from about 20% to about 60% of the surface area of each side of the web to which it is applied.

The thickness of the resulting non-fibrous polymeric surface structures can vary depending upon the ingredients of the additive composition and the amount applied. In general, for instance, the thickness can be from about 0.01 microns to about 10 microns. At higher add-on levels, for instance, the thickness may be from about 3 microns to about 8 microns. At lower add-on levels, however, the thickness may be from about 0.1 microns to about 1 micron, such as from about 0.3 microns to about 0.7 microns.

As described above, the non-fibrous polymeric surface structures impart a lotiony and soft feel to the tissue. A test that measures one aspect of softness is called the Stick-Slip Test (hereinafter described). During the Stick-Slip Test, a sled is pulled over a surface of the basesheet while the resistive force is measured. A higher stick-slip number indicates a more lotiony surface with lower drag forces. Tissue webs treated in accordance with this invention can have a Stick-Slip Test value on one side of about −0.01 or greater, more specifically from about −0.006 to about 0.1, more particularly from 0 to about 0.1, and still more specifically from 0 to about 0.07.

The basesheets treated in accordance with the present disclosure can be made entirely from cellulosic fibers, such as pulp fibers, or can be made from a mixture of fibers. For instance, the basesheets can comprise cellulosic fibers in combination with synthetic fibers. Basesheets that may be treated in accordance with the present disclosure include wet-laid tissue webs, such as wet-pressed creped webs, uncreped throughdried webs and creped throughdried webs, air-laid webs, hydro-entangled webs, coform webs, and the like.

The additive composition generally contains an aqueous dispersion comprising at least one thermoplastic resin, water, and, optionally, at least one dispersing agent. The thermoplastic resin is present within the dispersion at a relatively small particle size. For example, the average volumetric particle size of the polymer may be less than about 5 microns. The actual particle size may depend upon various factors including the thermoplastic polymer that is present in the dispersion. Thus, the average volumetric particle size may be from about 0.05 microns to about 5 microns, such as less than about 4 microns, such as less than about 3 microns, such as less than about 2 microns, such as less than about 1 micron. Particle sizes can be measured on a Coulter LS230 light-scattering particle size analyzer or other suitable device. When present in the aqueous dispersion and when present in the tissue web, the thermoplastic resin is typically found in a non-fibrous form.

The particle size distribution of the polymer particles in the dispersion may be less than or equal to about 2.0, such as less than 1.9, 1.7 or 1.5, more specifically from about 1.0 to about 2.0.

Examples of aqueous dispersions that may be incorporated into the additive composition of the present disclosure are disclosed, for instance, in U.S. Patent Application Publication No. 2005/0100754, U.S. Patent Application Publication No. 2005/0192365, PCT Publication No. WO 2005/021638, and PCT Publication No. WO 2005/021622, which are all incorporated herein by reference.

The thermoplastic resin contained within the additive composition may vary depending upon the particular application and the desired result. In one embodiment, for instance, thermoplastic resin is an olefin polymer. As used herein, an olefin polymer refers to a class of unsaturated open-chain hydrocarbons having the general formula $C_nH_{2n}$. The olefin polymer may be present as a copolymer, such as an interpolymer. As used herein, a substantially olefin polymer refers to a polymer that contains less than about 1% substitution. The olefin polymer may comprise an interpolymer of ethylene and at least one comonomer comprising an alkene, such as 1-octene. The additive composition may also contain a dispersing agent, such as a carboxylic acid. Examples of particular dispersing agents, for instance, include fatty acids, such as oleic acid or stearic acid.

In one particular embodiment, the additive composition may contain an ethylene and octene copolymer in combination with an ethylene-acrylic acid copolymer. The ethylene-acrylic acid copolymer is not only a thermoplastic resin, but may also serve as a dispersing agent. The ethylene and octene copolymer may be present in combination with the ethylene-acrylic acid copolymer in a weight ratio of from about 1:10 to about 10:1, such as from about 2:3 to about 3:2.

The olefin polymer composition may exhibit a crystallinity of less than about 50%, such as less than about 20%. The olefin polymer may also have a melt index of less than about 1000 g/10 min, such as less than about 700 g/10 min. The olefin polymer may also have a relatively small particle size, such as from about 0.1 micron to about 5 microns when contained in an aqueous dispersion.

In an alternative embodiment, the additive composition may contain an ethylene-acrylic acid copolymer. The ethylene-acrylic acid copolymer may be present in the additive composition in combination with a dispersing agent, such as a fatty acid.

In one particular embodiment, for instance, the olefin polymer may comprise an alpha-olefin interpolymer of ethylene with at least one comonomer selected from the group consisting of a $C_4$-$C_{20}$ linear, branched or cyclic diene, or an ethylene vinyl compound, such as vinyl acetate, and a compound represented by the formula $H_2C{=}CHR$ wherein R is a $C_1$-$C_{20}$ linear, branched or cyclic alkyl group or a $C_6$-$C_{20}$ aryl group. Examples of comonomers include propylene, 1-butene, 3-methyl-1-butene, 4-methyl-1-pentene, 3-methyl-1-pentene, 1-heptene, 1-hexene, 1-octene, 1-decene, and 1-dodecene. In some embodiments, the interpolymer of ethylene has a density of less than about 0.92 g/cc.

In other embodiments, the thermoplastic resin comprises an alpha-olefin interpolymer of propylene with at least one comonomer selected from the group consisting of ethylene, a $C_4$-$C_{20}$ linear, branched or cyclic diene, and a compound represented by the formula $H_2C{=}CHR$ wherein R is a $C_1$-$C_{20}$ linear, branched or cyclic alkyl group or a $C_6$-$C_{20}$ aryl group. Examples of comonomers include ethylene, 1-butene, 3-methyl-1-butene, 4-methyl-1-pentene, 3-methyl-1-pentene, 1-heptene, 1-hexene, 1-octene, 1-decene, and 1-dodecene. In some embodiments, the comonomer is present at about 5% by weight to about 25% by weight of the interpolymer. In one embodiment, a propylene-ethylene interpolymer is used.

Other examples of thermoplastic resins which may be used in the present disclosure include homopolymers and copolymers (including elastomers) of an olefin such as ethylene, propylene, 1-butene, 3-methyl-1-butene, 4-methyl-1-pentene, 3-methyl-1-pentene, 1-heptene, 1-hexene, 1-octene, 1-decene, and 1-dodecene as typically represented by polyethylene, polypropylene, poly-1-butene, poly-3-methyl-1-butene, poly-3-methyl-1-pentene, poly-4-methyl-1-pentene, ethylene-propylene copolymer, ethylene-1-butene copolymer, and propylene-1-butene copolymer; copolymers (including elastomers) of an alpha-olefin with a conjugated or non-conjugated diene as typically represented by ethylene-butadiene copolymer and ethylene-ethylidene norbornene copolymer; and polyolefins (including elastomers) such as copolymers of two or more alpha-olefins with a conjugated or non-conjugated diene as typically represented by ethylene-propylene-butadiene copolymer, ethylene-propylene-dicyclopentadiene copolymer, ethylene-propylene-1,5-hexadiene copolymer, and ethylene-propylene-ethylidene norbornene copolymer; ethylene-vinyl compound copolymers such as ethylene-vinyl acetate copolymers with N-methylol functional comonomers, ethylene-vinyl alcohol copolymers with N-methylol functional comonomers, ethylene-vinyl chloride copolymer, ethylene acrylic acid or ethylene-(meth)acrylic acid copolymers, and ethylene-(meth)acrylate copolymer; styrenic copolymers (including elastomers) such as polystyrene, ABS, acrylonitrile-styrene copolymer, methylstyrene-styrene copolymer; and styrene block copolymers (including elastomers) such as styrene-butadiene copolymer and hydrate thereof, and styrene-isoprene-styrene triblock copolymer; polyvinyl compounds such as polyvinyl chloride, polyvinylidene chloride, vinyl chloride-vinylidene chloride copolymer, polymethyl acrylate, and polymethyl methacrylate; polyamides such as nylon 6, nylon 6,6, and nylon 12; thermoplastic polyesters such as polyethylene terephthalate and polybutylene terephthalate; polycarbonate, polyphenylene oxide, and the like. These resins may be used either alone or in combinations of two or more.

In particular embodiments, polyolefins such as polypropylene, polyethylene, and copolymers thereof and blends thereof, as well as ethylene-propylene-diene terpolymers are used. In some embodiments, the olefinic polymers include homogeneous polymers described in U.S. Pat. No. 3,645,992 by Elston; high density polyethylene (HDPE) as described in U.S. Pat. No. 4,076,698 to Anderson; heterogeneously branched linear low density polyethylene (LLDPE); heterogeneously branched ultra low linear density (ULDPE); homogeneously branched, linear ethylene/alpha-olefin copolymers; homogeneously branched, substantially linear ethylene/alpha-olefin polymers which can be prepared, for example, by a process disclosed in U.S. Pat. Nos. 5,272,236 and 5,278,272, the disclosure of which process is incorporated herein by reference; and high pressure, free radical polymerized ethylene polymers and copolymers such as low density polyethylene (LDPE). In still another embodiment of the present invention, the thermoplastic resin comprises an ethylene-carboxylic acid copolymer, such as ethylene-acrylic acid (EAA) and ethylene-methacrylic acid copolymers such as for example those available under the tradenames PRIMACOR™ from The Dow Chemical Company, NUCREL™ from DuPont, and ESCOR™ from ExxonMobil, and described in U.S. Pat. Nos. 4,599,392, 4,988,781, and 5,384,373, each of which is incorporated herein by reference in its entirety, and ethylene-vinyl acetate (EVA) copolymers. Polymer compositions described in U.S. Pat. Nos. 6,538,070, 6,566,446, 5,869,575, 6,448,341, 5,677,383, 6,316,549, 6,111,023, or 5,844,045, each of which is incorporated herein by reference in its entirety, are also suitable in some embodiments. Of course, blends of polymers can be used as well. In some embodiments, the blends include two different Ziegler-Natta polymers. In other embodiments, the blends can include blends of a Ziegler-Natta and a metallocene polymer. In still other embodiments, the thermoplastic resin used herein is a blend of two different metallocene polymers.

In one particular embodiment, the thermoplastic resin comprises an alpha-olefin interpolymer of ethylene with a comonomer comprising an alkene, such as 1-octene. The ethylene and octene copolymer may be present alone in the additive composition or in combination with another thermoplastic resin, such as ethylene-acrylic acid copolymer. Of particular advantage, the ethylene-acrylic acid copolymer not only is a thermoplastic resin, but also serves as a dispersing agent. For some embodiments, the additive composition should comprise a film-forming composition. It has been found that the ethylene-acrylic acid copolymer may assist in forming films, while the ethylene and octene copolymer lowers the stiffness. When applied to a tissue web, the composition may or may not form a film within the product, depending upon how the composition is applied and the amount of the composition that is applied. When forming a film on the tissue web, the film may be continuous or discontinuous. When present together, the weight ratio between the ethylene and octene copolymer and the ethylene-acrylic acid copolymer may be from about 1:10 to about 10:1, such as from about 3:2 to about 2:3.

The thermoplastic resin, such as the ethylene and octene copolymer, may have a crystallinity of less than about 50%, such as less than about 25%. The polymer may have been produced using a single site catalyst and may have a weight average molecular weight of from about 15,000 to about 5 million, such as from about 20,000 to about 1 million. The molecular weight distribution of the polymer may be from about 1.01 to about 40, such as from about 1.5 to about 20, such as from about 1.8 to about 10.

Depending upon the thermoplastic polymer, the melt index of the polymer may range from about 0.001 g/10 min to about 1,000 g/10 min, such as from about 0.5 g/10 min to about 800 g/10 min. For example, in one embodiment, the melt index of the thermoplastic resin may be from about 100 g/10 min to about 700 g/10 min.

The thermoplastic resin may also have a relatively low melting point. For instance, the melting point of the thermoplastic resin may be less than about 140° C., such as less than 130° C., such as less than 120° C. For instance, in one embodiment, the melting point may be less than about 90° C. The glass transition temperature of the thermoplastic resin may also be relatively low. For instance, the glass transition temperature may be less than about 50° C., such as less than about 40° C.

The one or more thermoplastic resins may be contained within the additive composition in an amount from about 1% by weight to about 96% by weight. For instance, the thermoplastic resin may be present in the aqueous dispersion in an amount from about 10% by weight to about 70% by weight, such as from about 20% to about 50% by weight.

In addition to at least one thermoplastic resin, the aqueous dispersion may also contain a dispersing agent. A dispersing agent is an agent that aids in the formation and/or the stabilization of the dispersion. One or more dispersing agents may be incorporated into the additive composition.

In general, any suitable dispersing agent can be used. In one embodiment, for instance, the dispersing agent comprises at least one carboxylic acid, a salt of at least one carboxylic acid, or carboxylic acid ester or salt of the carboxylic acid ester. Examples of carboxylic acids useful as a dispersant comprise fatty acids such as montanic acid, stearic acid, oleic acid, and the like. In some embodiments, the carboxylic acid, the salt of the carboxylic acid, or at least one carboxylic acid fragment of the carboxylic acid ester or at least one carboxylic acid fragment of the salt of the carboxylic acid ester has fewer than 25 carbon atoms. In other embodiments, the carboxylic acid, the salt of the carboxylic acid, or at least one carboxylic acid fragment of the carboxylic acid ester or at least one carboxylic acid fragment of the salt of the carboxylic acid ester has 12 to 25 carbon atoms. In some embodiments, carboxylic acids, salts of the carboxylic acid, at least one carboxylic acid fragment of the carboxylic acid ester or its salt has 15 to 25 carbon atoms are preferred. In other embodiments, the number of carbon atoms is 25 to 60. Some examples of salts comprise a cation selected from the group consisting of an alkali metal cation, alkaline earth metal cation, or ammonium or alkyl ammonium cation.

In still other embodiments, the dispersing agent is selected from the group consisting of ethylene-carboxylic acid polymers, and their salts, such as ethylene-acrylic acid copolymers or ethylene-methacrylic acid copolymers.

In other embodiments, the dispersing agent is selected from alkyl ether carboxylates, petroleum sulfonates, sulfonated polyoxyethylenated alcohol, sulfated or phosphated polyoxyethylenated alcohols, polymeric ethylene oxide/propylene oxide/ethylene oxide dispersing agents, primary and secondary alcohol ethoxylates, alkyl glycosides and alkyl glycerides.

When ethylene-acrylic acid copolymer is used as a dispersing agent, the copolymer may also serve as a thermoplastic resin.

In one particular embodiment, the aqueous dispersion contains an ethylene and octene copolymer, ethylene-acrylic acid copolymer, and a fatty acid, such as stearic acid or oleic acid. The dispersing agent, such as the carboxylic acid, may be present in the aqueous dispersion in an amount from about 0.1% to about 10% by weight.

In addition to the above components, the aqueous dispersion also contains water. Water may be added as deionized water, if desired. The pH of the aqueous dispersion is generally less than about 12, such as from about 5 to about 11.5, such as from about 7 to about 11. The aqueous dispersion may have a solids content of less than about 75%, such as less than about 70%. For instance, the solids content of the aqueous dispersion may range from about 5% to about 60%. In general, the solids content can be varied depending upon the manner in which the additive composition is applied or incorporated into the tissue web. For instance, when incorporated into the tissue web during formation, such as by being added with an aqueous suspension of fibers, a relatively high solids content can be used. When topically applied such as by spraying or printing, however, a lower solids content may be used in order to improve processability through the spray or printing device.

While any method may be used to produce the aqueous dispersion, in one embodiment, the dispersion may be formed through a melt-kneading process. For example, the kneader may comprise a Banbury mixer, single-screw extruder or a multi-screw extruder. The melt-kneading may be conducted under the conditions which are typically used for melt-kneading the one or more thermoplastic resins.

In one particular embodiment, the process includes melt-kneading the components that make up the dispersion. The melt-kneading machine may include multiple inlets for the various components. For example, the extruder may include four inlets placed in series. Further, if desired, a vacuum vent may be added at an optional position of the extruder.

In some embodiments, the dispersion is first diluted to contain about 1 to about 3% by weight water and then, subsequently, further diluted to comprise greater than about 25% by weight water.

For purposes herein, the term "tissue" means a paper sheet having a Bulk (hereinafter defined) of about 2 $cm^3$ or greater/gram, more specifically about 5 $cm^3$ or greater per gram, more specifically from about 3 to about 25 $cm^3$ per gram, more specifically from about 5 to about 20 $cm^3$ per gram and still more specifically from about 8 to about 15 $cm^3$ per gram. Such tissue sheets are particularly useful for facial tissue, bath tissue, paper towels and the like.

For purposes of this invention, the basis weight (conditioned) of a tissue sheet or product, on a per ply basis, can be from about 10 grams per square meter (gsm) to about 60 gsm, more particularly from about 15 to about 40 gsm. The tissue products can be single-ply tissue products or multiple-ply tissue products. For instance, in one embodiment, the product can consist of two plies or three plies.

The absorbent rate of aged products of this invention, as measured by the Water Drop Absorbency Rate test (hereinafter described) can be about 40 seconds or less, more specifically from about 0.5 to about 30 seconds, more specifically from about 0.5 to about 20 seconds, more specifically from about 0.5 to about 10 seconds and still more specifically from about 2 to about 10 seconds.

The absorbent rate of aged products of this invention, as measured by the Hercules Size Test (HST) (hereinafter described) can be about 40 seconds or less, more specifically from about 1 to about 30 seconds, more specifically from about 1 to about 20 seconds, and still more specifically from about 1 to about 15 seconds.

The geometric mean tensile strength of the products of this invention can be, without limitation, from about 600 to about 1300 grams per 3 inches, more particularly from about 700 to about 1200 grams per 3 inches and still more specifically from about 800 to about 1100 grams per 3 inches.

DETAILED DESCRIPTION OF THE DRAWINGS

Figure 1:
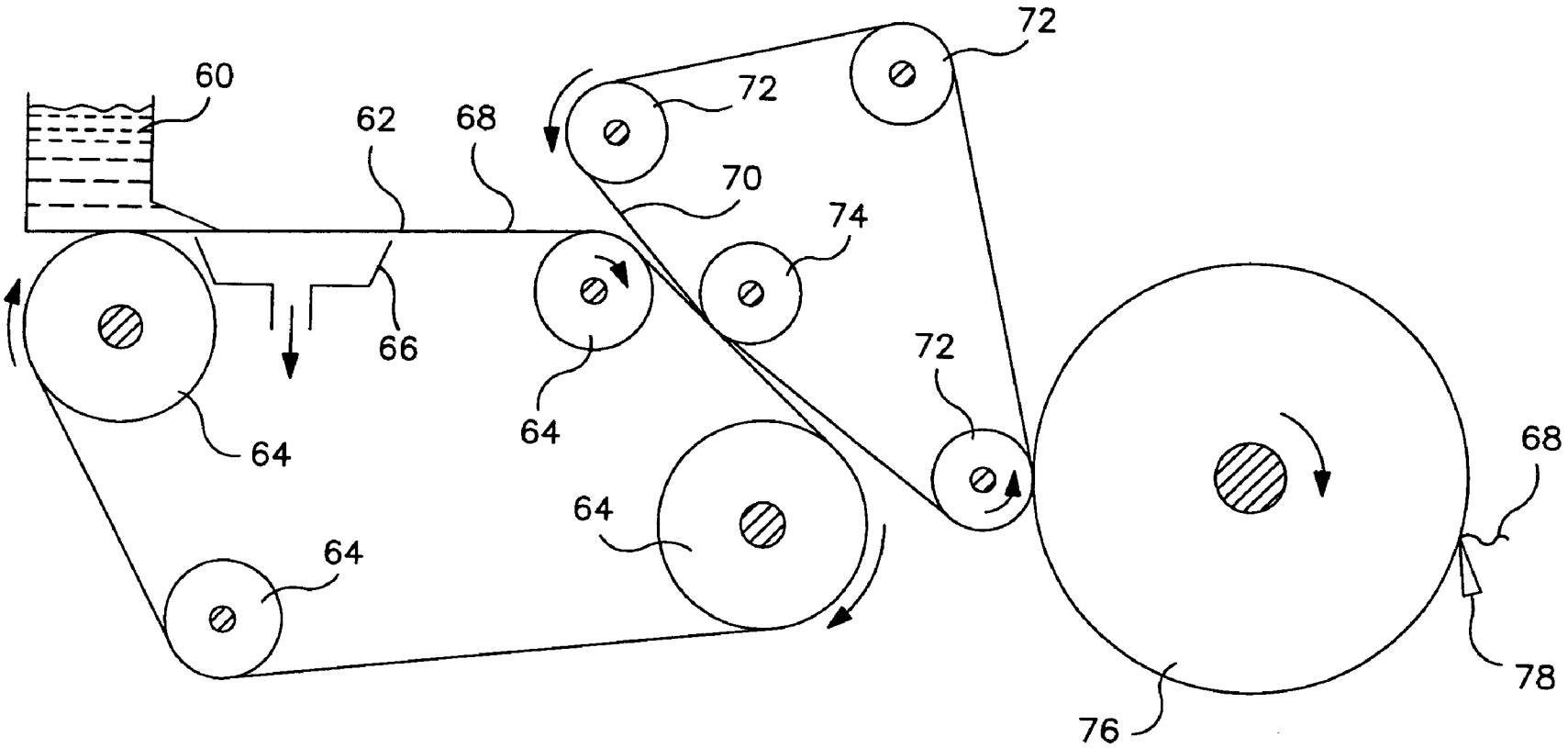
FIG. 1 is a schematic diagram of a process for forming wet-pressed, creped tissue webs for use in accordance with this invention.
Figure 2A:
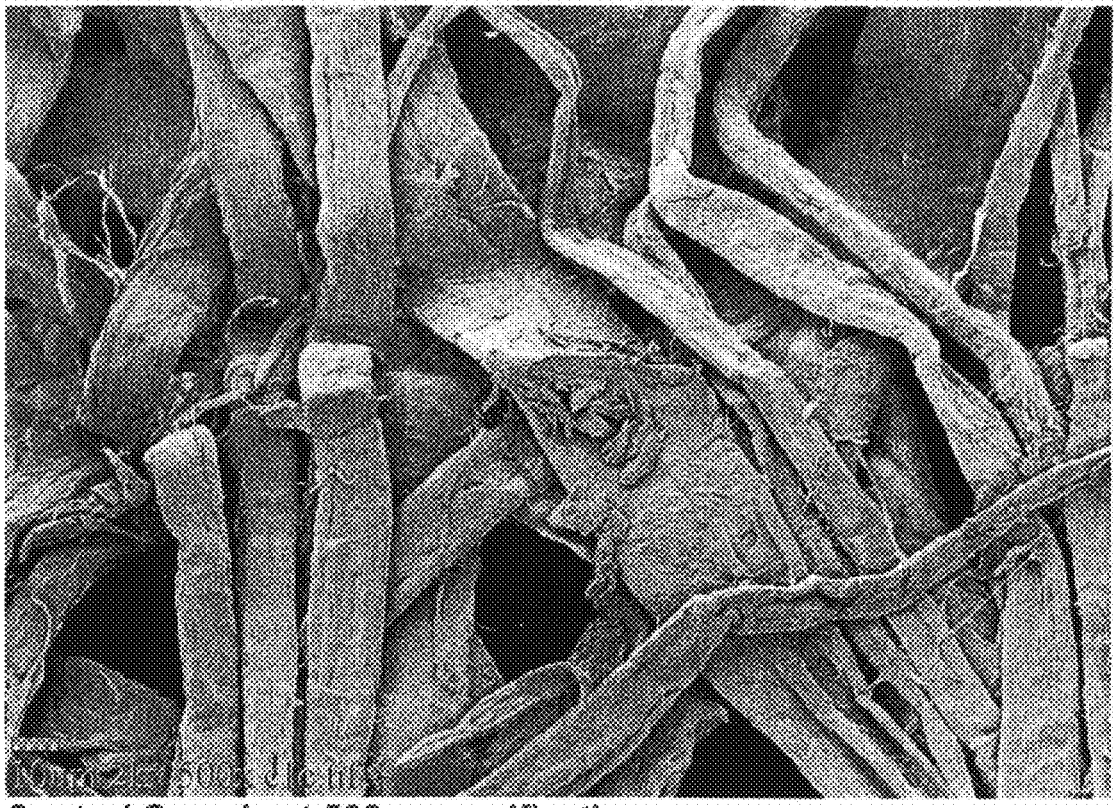
FIG. 2A is a photomicrograph (500× magnification) of a control tissue sheet sample not having non-fibrous polymeric surface structures.
Figure 2B:
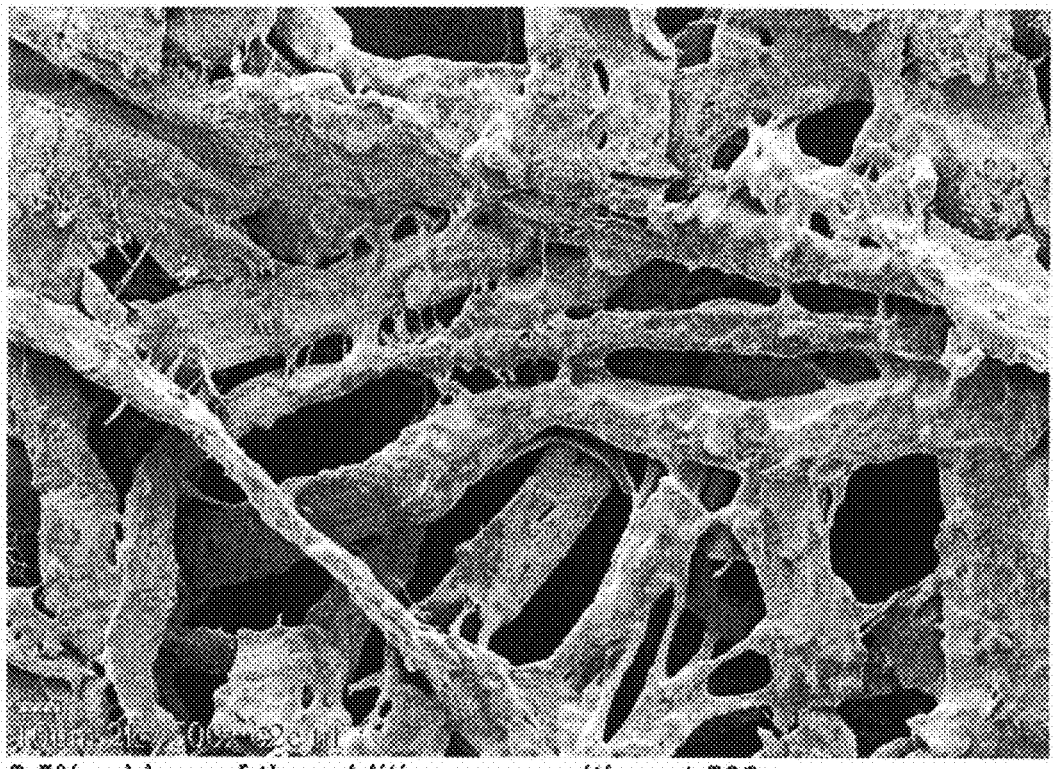
FIG. 2B is a photomicrograph (500× magnification) of a creped tissue sheet in accordance with this invention as described in Example 1, prior to the application of the softening composition, having non-fibrous polymeric surface structures resulting from the addition of a 2.5 percent add-on of an additive composition to the Yankee dryer surface prior to creping.
Figure 2C:
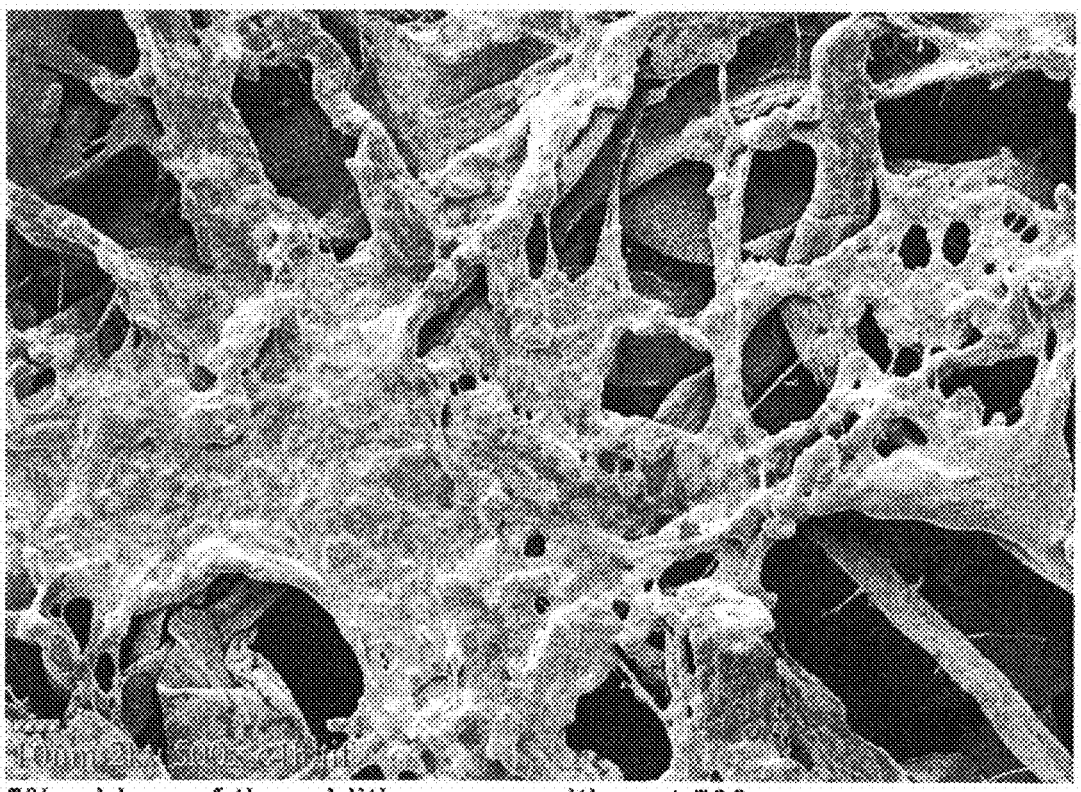
FIG. 2C is a photomicrograph (500× magnification) of a creped tissue sheet in accordance with this invention, prior to the application of the softening composition, having non-fibrous polymeric surface structures resulting from the addition of a 5 percent add-on of an additive composition to the Yankee dryer surface prior to creping.
Figure 2D:
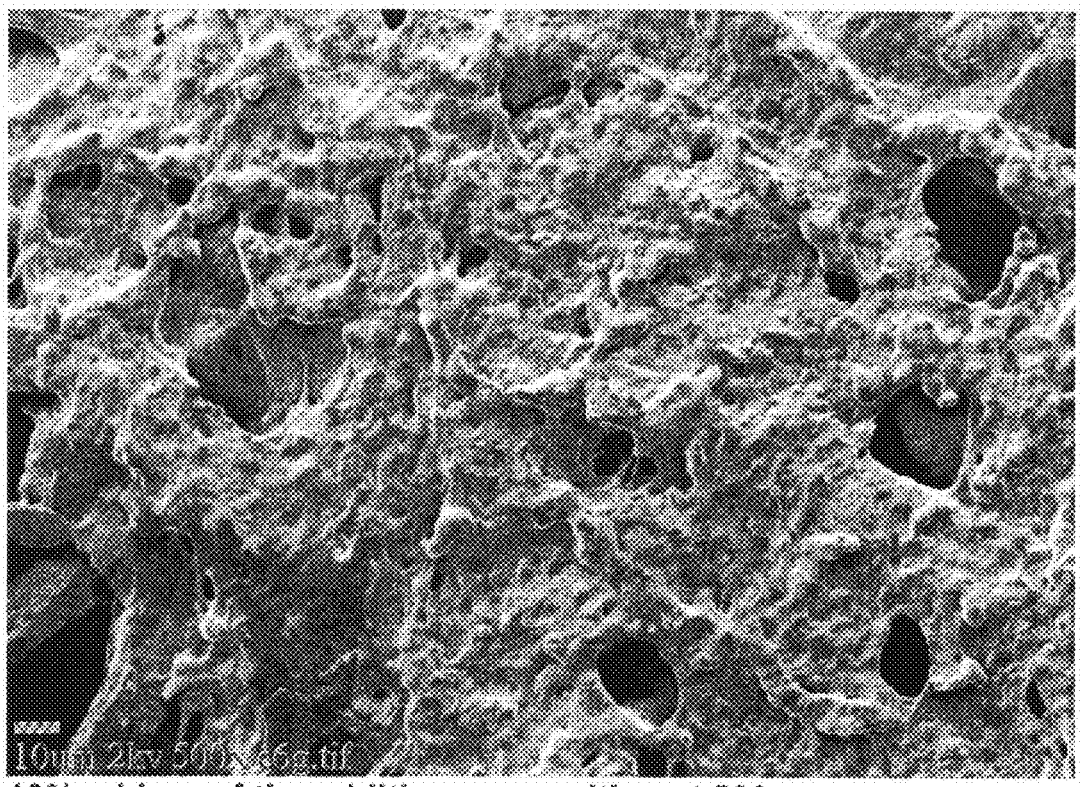
FIG. 2D is a photomicrograph (500× magnification) of a creped tissue sheet in accordance with this invention, prior to the application of the softening composition, having non-fibrous polymeric surface structures resulting from the addition of a 10 percent add-on of an additive composition to the Yankee dryer surface prior to creping.
Figure 3:
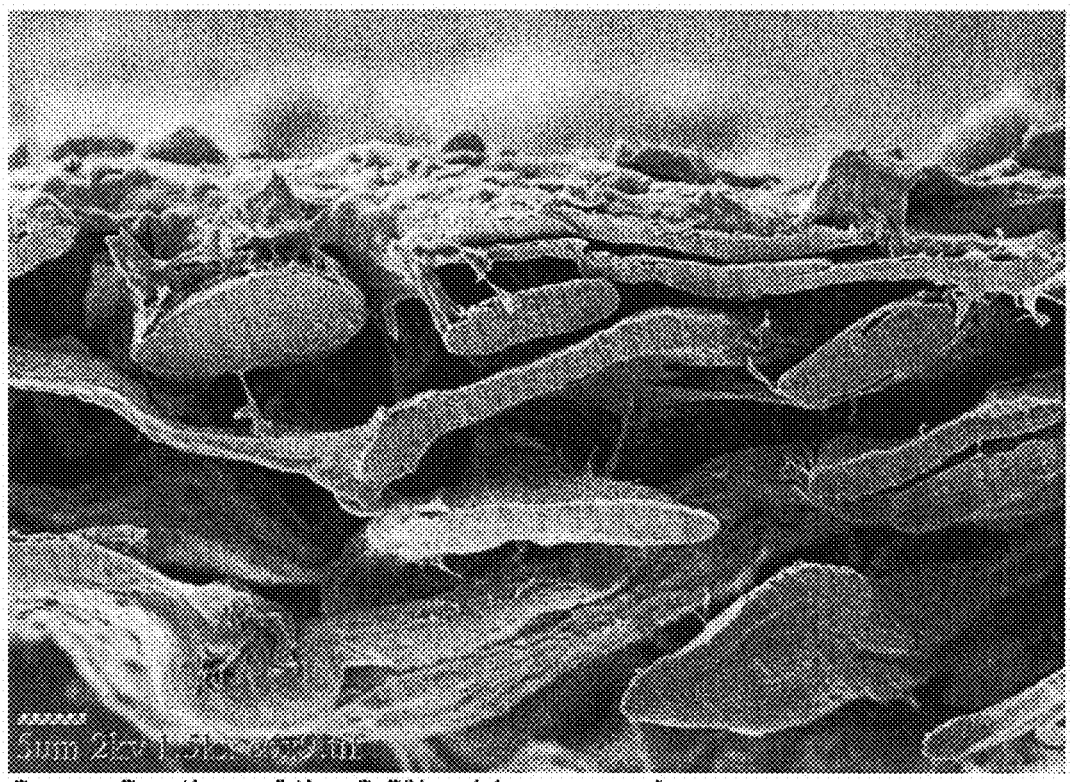
FIG. 3 is a magnified cross-sectional photograph of a segment of a creped tissue sheet in accordance with this invention, prior to the application of the softening composition, having non-fibrous polymeric surface structures resulting from the addition of an additive composition to the Yankee dryer surface prior to creping. As shown, the non-fibrous polymeric surface structures reside on or near the surface of the tissue sheet.

Referring to FIG. 1, a method for making tissue sheets having non-fibrous polymeric surface structures for use in accordance with this invention and as described in the Examples is described. Specifically, shown is a headbox 60 which emits an aqueous suspension of fibers onto a forming fabric 62 which is supported and driven by a plurality of guide rolls 64. A vacuum box 66 is disposed beneath forming fabric 62 and is adapted to remove water from the fiber furnish to assist in forming a web. From forming fabric 62, a formed web 68 is transferred to a second fabric 70, which may be either a wire or a felt. Fabric 70 is supported for movement around a continuous path by a plurality of guide rolls 72. Also included is a pick up roll 74 designed to facilitate transfer of web 68 from fabric 62 to fabric 70.

From fabric 70, web 68 is transferred to the surface of a rotatable heated dryer drum 76, such as a Yankee dryer. In accordance with this invention, the additive composition can be incorporated into the tissue web 68 by topically applying the additive composition to the tissue web at any time during the tissue making process after web formation. In one particular embodiment, the additive composition of the present disclosure may be applied topically to the tissue web 68 while the web is traveling on the fabric 70 or may be applied to the surface of the dryer drum 76 for transfer onto one side of the tissue web 68. In this manner, the additive composition is used to adhere the tissue web 68 to the dryer drum 76. In this embodiment, as web 68 is carried through a portion of the rotational path of the dryer surface, heat is imparted to the web causing most of the moisture contained within the web to be evaporated. Web 68 is then removed from dryer drum 76 by a creping blade 78. Creping web 78 as it is formed further reduces internal bonding within the web and increases softness. Applying the additive composition to the web during creping, on the other hand, may increase the strength of the web.

Test Methods

The "Basis Weight" of the tissue sheet specimens was determined using a modified TAPPI T410 procedure. The pre-plied samples were conditioned at 23° C. 1° C. and 50±2% relative humidity for a minimum of 4 hours. After conditioning a stack of 16-3"×3" pre-plied samples was cut using a die press and associated die. This represents a tissue sheet sample area of 144 $in^2$ or 0.0929 $m^2$. Examples of suitable die presses are TMI DGD die press manufactured by Testing Machines, Inc. located at Islandia, N.Y., or a Swing Beam testing machine manufactured by USM Corporation, located at Wilmington, Mass. Die size tolerances are +/−0.008 inches in both directions. The specimen stack is then weighed to the nearest 0.001 gram on a tared analytical balance. The basis weight in grams per square meter (gsm) is calculated using the following equation:

$$\text{Basis weight (conditioned)} = \text{stack wt. in grams}/(0.0929\ m^2)$$

The "Caliper" is the thickness of a tissue product under a standard load. For purposes herein, "1 sheet" refers to one sheet of the complete, multi-ply or single-ply tissue product. For the Examples that follow, samples of the 3-ply prototypes were conditioned for at least 4 hours at 23.0° C.±1.0° C., 50.0±2.0% relative humidity prior to testing. The 1 sheet caliper (thickness) of each prototype was measured using an EMVECO 200-A Microgage automated micrometer (EMVECO, Inc. Newburg, Oreg.). The micrometer has an anvil diameter of 2.22 inches (56.4 millimeters) and an anvil pressure of 132 grams per square inch (per 6.45 square centimeters) (2.0 kPa). Each specimen was individually measured avoiding the crimping and any wrinkles, folds, or defects in the sheet. Ten specimens were measured per prototype and the average 1 sheet caliper reported in microns (μm).

The "Bulk" of a tissue sheet is defined as the quotient of the caliper, expressed in microns, divided by the basis weight, expressed in grams per square meter. The resulting bulk is expressed as cubic centimeters per gram.

The "Geometric Mean Tensile Strength" (GMT) is the square root of the product of the dry machine direction (MD) tensile strength multiplied by the dry cross-machine direction (CD) tensile strength and is expressed as grams per 3 inches of sample width. The MD tensile strength is the peak load per 3 inches of sample width when a sample is pulled to rupture in the machine direction. Similarly, the CD tensile strength is the peak load per 3 inches of sample width when a sample is pulled to rupture in the cross-machine direction. The tensile curves are obtained under laboratory conditions of 23.0°

C.±1.0° C., 50.0±2.0% relative humidity and after the tissue samples have equilibrated to the testing conditions for a period of not less than four hours.

The samples for tensile strength testing are cut into strips 3 inches wide (76 mm) by at least 5 inches (127 mm) long in either the machine direction (MD) or cross-machine direction (CD) orientation using a JDC Precision Sample Cutter (Thwing-Albert Instrument Company, Philadelphia, Pa., Model No. SC130). The tensile tests are measured on an MTS Systems Synergie 100 run with TestWorks® 4 software version 4.08 (MTS Systems Corp., Eden Prairie, Minn.).

The load cell is selected from either a 50 Newton or 100 Newton maximum, depending on the strength of the sample being tested, such that the majority of peak load values fall between 10-90% of the load cell's full scale value. The gauge length between jaws is 4+/−0.04 inches (102+/−1 mm). The jaws are operated using pneumatic-action and are rubber coated. The minimum grip face width is 3 inches (76 mm), and the approximate height of a jaw is 0.5 inches (13 m). The crosshead speed is 10+/−0.4 inches/min (254+/−10 mm/min), and the break sensitivity is set at 65%.

The sample is placed in the jaws of the instrument, centered both vertically and horizontally. The test is then started and ends when the specimen breaks. The peak load is recorded as either the "MD tensile strength" or the "CD tensile strength" of the specimen depending on direction of the sample being tested. Ten (10) specimens per sample are tested in each direction with the arithmetic average being reported as either the MD or CD tensile strength value for the product. The geometric mean tensile strength is calculated from the following equation:

$$GMT=(MD\ Tensile*CD\ Tensile)^{1/2}$$

The "Hercules Size Test" (HST) measures how long it takes for a liquid to travel through a tissue sheet. Hercules size testing was done in general accordance with TAPPI method T 530 PM-89, Size Test for Paper with Ink Resistance. Hercules Size Test data was collected on a Model HST tester using white and green calibration tiles and the black disk provided by the manufacturer. A 2% Naphthol Green N dye diluted with distilled water to 1% was used as the dye. All materials are available from Hercules, Inc., Wilmington, Del.

Prior to testing, all final product specimens were aged at ambient conditions for at least three weeks and then conditioned for at least 4 hours at 23.0° C.±1.0° C., 50.0±2.0% relative humidity. The test is sensitive to dye solution temperature so the dye solution should also be equilibrated to the controlled condition temperature for a minimum of 4 hours before testing.

Six tissue sheets as prepared, or commercially sold (18 plies for a 3-ply tissue product, 12 plies for a two-ply product, 6 plies for a single ply product, etc.), form the specimen for testing. Specimens are cut to an approximate dimension of 2.5×2.5 inches. The instrument is standardized with white and green calibration tiles per the manufacturer's directions. The specimen (18 plies for a 3-ply tissue prototype) is placed in the sample holder with the outer surface of the plies facing outward. The specimen is then clamped into the specimen holder. The specimen holder is then positioned in the retaining ring on top of the optical housing. Using the black disk, the instrument zero is calibrated. The black disk is removed and 10+/−0.5 milliliters of dye solution are dispensed into the retaining ring and the timer started while placing the black disk back over the specimen. The test time in seconds (sec.) is recorded from the instrument. The average of five tests is the HST.

The "Water Drop Absorbency Rate" is the time required, in seconds, for a tissue product specimen (single-ply, two-ply or three-ply, etc.) to absorb 0.1 ml of distilled or deionized water. Water drop absorbency rates are measured after aging the samples at ambient conditions for at least three weeks and thereafter conditioning the samples at 23.0° C.±1.0° C., 50.0±2.0% relative humidity for a period of at least 4 hours.

The specimen (3-ply specimens for the Examples) is draped over the top of a 600 ml beaker and covered with a template to hold the specimen in place. The template is a 5 inch by 5 inch square of Plexiglas® with a two inch diameter hole in the center. The purpose of the template is to hold the sample in place on the top of the beaker. A lamp is set up to illuminate the tissue surface. 100 microliters, (0.1 ml) of distilled or deionized water (23.0° C.±2.0° C.) is dispensed from an Eppendorf style pipet. The pipet tip is positioned one inch above the surface of the test specimen at a right angle to the specimen's surface near the center of the specimen. A stopwatch is started immediately after the water is dispensed onto the test specimen. The time in seconds for the water drop to completely be absorbed by the sample is measured to the nearest 0.1 second. The end point is reached when the water is absorbed to the point where light is not reflected from the surface of the water. If after 180 seconds the sample is not completely absorbed the test is stopped and the time recorded as greater than 180 seconds. The procedure is repeated in a new, dry area on the same side of the specimen. The specimen is then turned over and two more tests are conducted for a total of 4 tests per specimen. A total of 5 specimens are tested and the average of all 20 time measurements is recorded as the Water Drop Absorbency Rate. The Water Drop Absorbency Rate values are reported in Tables 1 and 2.

The "Stick-Slip Test" is a measure of softness. A sled pulled over a surface by a string will not move until the force in the string is high enough to overcome the static coefficient of friction (COF) times the normal load. However, as soon as the sled starts to move the static COF gives way to the lower kinetic COF, so the pulling force in the string is unbalanced and the sled accelerates until the tension in the string is released and the sled stops (sticks). The tension then builds again until it is high enough to overcome the static COF, and so on. The frequency and amplitude of the oscillations depend upon the difference between the static COF and the kinetic COF, but also upon the length and stiffness of the string (a stiff, short string will let the force drop down almost immediately when the static COF is overcome so that the sled jerks forward only a small distance), and upon the speed of travel. Higher speeds tend to reduce stick-slip behavior.

Static COF is higher than kinetic COF because two surfaces in contact under a load tend to creep and comply with each other and increase the contact area between them. COF is proportional to contact area so more time in contact gives a higher COF. This helps explain why higher speeds give less stick-slip: there is less time after each slip event for the surfaces to comply and for the static COF to rise. For many materials the COF decreases with higher speed sliding because of this reduced time for compliance. However, some materials (typically soft or lubricated surfaces) actually show an increase in COF with increasing speed because the surfaces in contact tend to flow either plastically or viscoelastically and dissipate energy at a rate proportional to the rate at which they are sheared. Materials which have increasing COF with velocity do not show stick-slip because it would take more force to make the sled jerk forward than to continue at a constant slower rate. Such materials also have a static COF equal to their kinetic COF. Therefore, measuring the slope of the COF versus velocity curve is a good means of predicting whether a material is likely to show stick-slip: more negative slopes will stick-slip easily, while more positive slopes will not stick-slip even at very low velocities of sliding.

Figure 4:
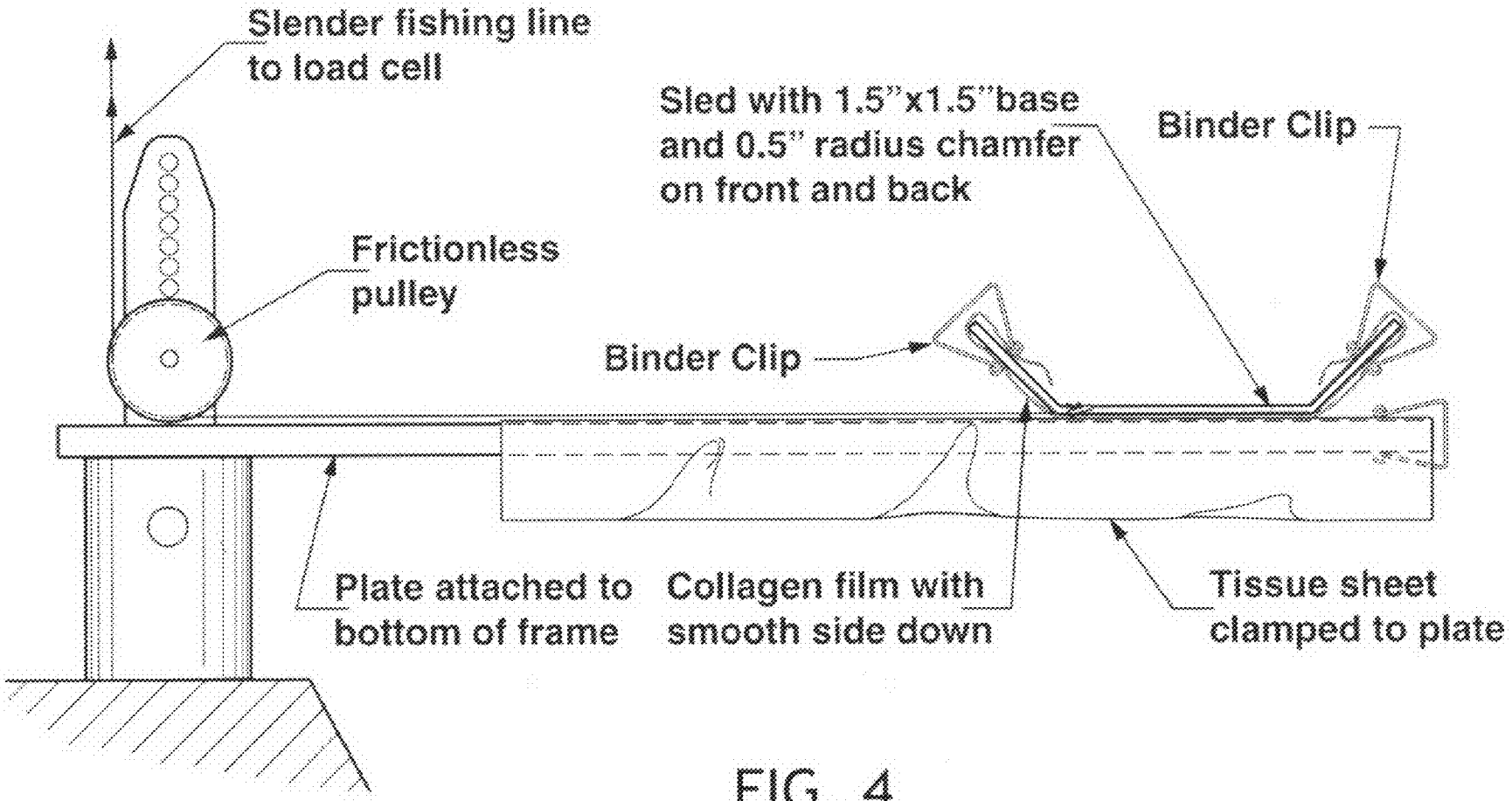
FIG. 4 is a schematic illustration of the apparatus for carrying out the Stick-Slip Test.

According to the Stick-Slip test, the variation in COF with velocity of sliding is measured using an Alliance RT/1 tensile frame equipped with MTS TestWorks 4 software. A diagram of part of the testing apparatus is shown in FIG. 4. As illustrated, a plate is fixed to the lower part of the frame, and a tissue sheet (the sample) is clamped to this plate. An aluminum sled with a 1.5" by 1.5" flat surface with a ½" radius on the leading and trailing edges is attached to the upper (moving part) of the frame by means of a slender fishing line (30 lb, Stren clear monofilament from Remington Arms Inc, Madison, N.C.) lead though a nearly frictionless pulley up to a 50 N load cell. A 50.8 mm wide sheet of collagen film is clamped flat to the underside of the sled by means of 32 mm binder clips on the front and back of the sled. The total mass of the sled, film and clips is 81.1 g. The film is larger than the sled so that it fully covers the contacting surfaces. The collagen film may be obtained from NATURIN GmbH, Weinhein, Germany, under the designation of COFFI (Collagen Food Film), having a basis weight of 28 gsm. Another suitable film may be obtained from Viscofan USA Inc, 50 County Court, Montgomery AL 36105. The films are embossed with a small dot pattern. The flatter side of the film (with the dots dimpled down) should be facing down toward the tissue on the sled to maximize contact area between the tissue and collagen. The samples and the collagen film should be conditioned at 72 F and 50% RH for at least 6 hours prior to testing.

The tensile frame is programmed to drag the sled at a constant velocity (V) for a distance of 1 cm while the drag force is measured at a frequency of 100 hz. The average drag force measured between 0.2 cm and 0.9 cm is calculated, and kinetic COF is calculated as:

$$COF_V = \frac{f}{81.1} \tag{1}$$

Where f is the average drag force in grams, and 81.1 g is the mass of the sled, clips and film.

For each sample the COF is measured at 5, 10, 25, 50 and 100 cm/min. A new piece of collagen film is used for each sample.

The COF varies logarithmically with velocity, so that the data is described by the expression:

$$COF=\alpha+SSP\ \ln(V)$$

where "a" is the best fit COF at 1 cm/min and "SSP" is the Stick-Slip Parameter, showing how the COF varies with velocity. A higher value of SSP indicates a more lotiony, less prone to stick-slip sheet. SSP is measured for four tissue sheet samples for each code and the average is reported.

In the interests of brevity and conciseness, any ranges of values set forth in this specification are to be construed as written description support for claims reciting any sub-ranges having endpoints which are whole number values within the specified range in question. By way of a hypothetical illustrative example, a disclosure in this specification of a range of from 1 to 5 shall be considered to support claims to any of the following sub-ranges: 1-4; 1-3; 1-2; 2-5; 2-4; 2-3; 3-5; 3-4 and 4-5.

EXAMPLES

Example 1

Tissue basesheet webs having non-fibrous polymeric surface structures were made generally according to the method illustrated in FIG. 1. In order to adhere the tissue web to a creping surface, which in this embodiment comprised a Yankee dryer, additive compositions made according to the present disclosure were sprayed onto the dryer prior to contacting the dryer with the web.

Initially, northern softwood kraft (NSWK) pulp was dispersed in a pulper for 30 minutes at 4% consistency at about 100 degrees F. Then, the NSWK pulp was transferred to a dump chest and subsequently diluted to approximately 3% consistency. Then, the NSWK pulp was refined at 0.6 to 4.5 hp-days/metric ton depending on the strength targets. The above softwood fibers were utilized as the inner strength layer in a 3-layer tissue structure. The NSWK layer contributed approximately 35% of the final sheet weight. Two kilograms KYMENE® 6500, available from Hercules, Incorporated, located in Wilmington, Del., U.S.A., per metric ton of wood fiber was added to the furnish prior to the headbox.

Aracruz ECF, a eucalyptus hardwood kraft (EHWK) pulp available from Aracruz, located in Rio de Janeiro, RJ, Brazil, was dispersed in a pulper for 30 minutes at about 4% consistency at about 100 degrees Fahrenheit. The EHWK pulp was then transferred to a dump chest and subsequently diluted to about 3% consistency. The EHWK pulp fibers represent the two outer layers of the 3-layered tissue structure. The EHWK layers contributed approximately 65% of the final sheet weight. Two kilograms KYMENE® 6500 per metric ton of wood fiber were added to the furnish prior to the headbox.

The pulp fibers from the machine chests were pumped to the headbox at a consistency of about 0.1%. Pulp fibers from each machine chest were sent through separate manifolds in the headbox to create a 3-layered tissue structure. The fibers were deposited onto a felt in a crescent former, similar to the process illustrated in FIG. 1.

The wet sheet, about 10-20% consistency, was adhered to a Yankee dryer, traveling at about 2500 feet per minute (fpm) (750 meters per minute (mpm)) through a nip via a pressure roll. The consistency of the wet sheet after the pressure roll nip (post-pressure roll consistency or "PPRC') was approximately 40%. The wet sheet adhered to the Yankee dryer due to the additive composition that is applied to the dryer surface. Spray booms situated underneath the Yankee dryer sprayed the additive composition, described in the present disclosure, onto the dryer surface at an addition level of 200 or 400 milligrams per square meter (mg/m$^2$). To prevent the felt from becoming contaminated by the additive composition, and to maintain desired sheet properties, a shield was positioned between the spray boom and the pressure roll.

The additive composition applied to the web was a 60/40 dispersion of AFFINITY™ EG8200/PRIMACOR™ 5980i; the PRIMACOR™ 5980i was the dispersing agent. This dispersion has a solids content of about 40%, particle size of 1-2 microns, pH of 9-11, and a viscosity of 200-500 cP. DOWICIL™ 200 antimicrobial, which is a preservative with the active composition of 96% cis 1-(3-chloroallyl)-3,5,7-triaza-1-azoniaadamantane chloride (also known as Quaternium-15) obtained from The Dow Chemical Company, was also present in the additive composition.

The percent solids in solution for the different additive compositions were varied to deliver 200 or 400 mg/m$^2$ spray coverage on the Yankee dryer. Varying the solids content in solution also varies the amount of solids incorporated into the base web. For instance, at 200 mg/m$^2$ spray coverage on the Yankee dryer, it is estimated that about 2% additive composition solids is incorporated into the tissue web. At 400 mg/m$^2$ spray coverage on the Yankee dryer, it is estimated that about 4% additive composition solids is incorporated into the tissue web.

The sheet was dried to about 95-98% consistency as it traveled on the Yankee dryer and to the creping blade. The creping blade subsequently scraped the tissue sheet and a portion of the additive composition off the Yankee dryer. The creped tissue basesheet was then wound onto a core traveling at about 1970 fpm (600 mpm) into soft rolls for converting. The resulting tissue basesheet had an air-dried basis weight of about 14.2 gsm.

Three soft rolls of the creped tissue were plied, calendered, crimped, slit, and rewound so that both creped sides were on the outside of the 3-ply structure. The 3-ply sheet was calendered between two steel rolls to a 3-ply target caliper of 280 microns. Mechanical crimping on the edges of the structure held the plies together. The plied sheet was then slit on the edges to a standard width of approximately 8.5 inches and rewound into a hard roll ready for post treatment and conversion into a folded tissue. Alternatively, post treatment was conducted between the crimping and slitting operations to create a post treated tissue, hard roll ready for conversion into folded tissue.

Basesheets and hard rolls of the following descriptions were created.

| Code | Basis Weight (1-ply, gsm) | HW:SW Ratio* | Additive Amount (mg/m$^2$) | Hard Roll GMT (3-ply, g/3") |
|---|---|---|---|---|
| 302 | 14.2 | 66:34 | 200 | 1200 |
| US-2 | 14.1 | 64:36 | 400 | 1248 |
| US-3 | 14.3 | 62:38 | 400 | 1448 |

*Hardwood:Softwood ratio

Comparative Example 1

A 3-ply hard roll of code 302 from Example 1 was unwound, folded and cut into individual tissues. The folded tissues, Code 302, were subjected to various standardized tests. The results are shown in Table 1 of Example 2.

Comparative Example 2

A 3-ply hard roll of Code 302 from Example 1 was post treated with GE silicone emulsion Y-14866. The Y-14868 emulsion was printed on both outer sides of the 3-ply tissue web via a simultaneous offset rotogravure printing process. The gravure rolls were electronically engraved, chrome-over-copper rolls supplied by Southern Graphics Systems, located at Louisville, Ky. The rolls had a line screen of 360 cells per lineal inch and a volume of 1.25 Billion Cubic Microns (BCM) per square inch of roll surface. The rubber backing offset applicator rolls had a 75 Shore A durometer cast polyurethane surface and were supplied by American Roller Company, located at Union Grove, Wis. The process was set up to a condition having 0.25 inch interference between the gravure rolls and the rubber backing rolls and 0.003 inch clearance between the facing rubber backing rolls. The simultaneous offset/offset gravure printer was run at 138 feet per minute. The treated, 3-ply sheet was then folded, and cut into individual tissue sheets (8.5 inches in length). This process yielded a treatment level of 1.4 weight percent based on the weight of the treated tissue. The Y-14868 treated tissues, Code 321, were subjected to various standardized tests. The results are shown in Table 1 of Example 2.

Comparative Example 3

A commercially produced, wet-pressed, 3-ply tissue hard roll was post treated with GE silicone emulsion Y-14866. The description of the 3-ply, hard roll is shown below.

| Code | Basis Weight (3-ply, gsm) | HW:SW Ratio | Additive Amount (mg/m$^2$) | Hardroll GMT (3-ply, g/3") |
|---|---|---|---|---|
| 314 | 43.8 | 70:30 | none | 1060 |

The Y-14868 emulsion was printed on both outer sides of the 3-ply tissue web via a simultaneous offset rotogravure printing process. The gravure rolls were electronically engraved, chrome-over-copper rolls supplied by Southern Graphics Systems, located at Louisville, Ky. The rolls had a line screen of 360 cells per lineal inch and a volume of 1.25 Billion Cubic Microns (BCM) per square inch of roll surface. The rubber backing offset applicator rolls had a 75 Shore A durometer cast polyurethane surface and were supplied by American Roller Company, located at Union Grove, Wis. The process was set up to a condition having 0.25 inch interference between the gravure rolls and the rubber backing rolls and 0.003 inch clearance between the facing rubber backing rolls. The simultaneous offset/offset gravure printer was run at 146 feet per minute. The treated, 3-ply sheet was then folded, and cut into individual tissue sheets (8.5 inches in length). This process yielded a treatment level of 0.5 weight percent based on the weight of the treated tissue. The Y-14868 treated tissues, Code 314, were subjected to various standardized tests. The results are shown in Table 1 of Example 2.

Example 2

A 3-ply hard roll of Code 302 from Example 1 was post-treated with a softening composition in accordance with this invention, identified as silicone emulsion blend 6014A. Silicone emulsion blend 6014A had the following composition:

| | |
|---|---|
| Polysiloxane (AF-23) | 6% by weight |
| Glycerin | 20% |
| Fatty alkyl derivative (Tergitol 15S9) | 18% |
| Antifoam | 0.5% |
| Preservative | 0.07% |
| Water | Balance to 100% |

Lactic acid was used to adjust to pH ~7

The 6014A formulation was printed on both outer sides of the 3-ply tissue web of via a simultaneous offset rotogravure printing process. The gravure rolls were electronically engraved, chrome-over-copper rolls supplied by Southern Graphics Systems, located at Louisville, Ky. The rolls had a line screen of 360 cells per lineal inch and a volume of 1.25 Billion Cubic Microns (BCM) per square inch of roll surface.

The rubber backing offset applicator rolls had a 75 Shore A durometer cast polyurethane surface and were supplied by American Roller Company, located at Union Grove, Wis. The process was set up to a condition having 0.25 inch interference between the gravure rolls and the rubber backing rolls and 0.003 inch clearance between the facing rubber backing rolls. The simultaneous offset/offset gravure printer was run at 146 feet per minute. The treated, 3-ply sheet was then folded, and cut into individual tissue sheets (8.5 inches in length). This process yielded a treatment level of 2.0 weight percent based on the weight of the treated tissue. The 6014A treated tissue sample, Code 322, was subjected to various standardized tests. The results are shown in Table 1.

TABLE 1

| | Example # | | | | | | | |
|---|---|---|---|---|---|---|---|---|
| | Comp. Ex. 3 | | Comp. Ex. 1 | | Comp. Ex. 2 | | Example 2 | |
| | Code | | | | | | | |
| | 314 | | 302 | | 321 | | 322 | |
| | Basesheet Additive Amount | | | | | | | |
| | None | | 200 mg/m$^2$ | | 200 mg/m$^2$ | | 200 mg/m$^2$ | |
| | Post Treatment | | | | | | | |
| | Y-14868 | | None | | Y-14868 | | 6014A | |
| | Plies | | | | | | | |
| | 3 | | 3 | | 3 | | 3 | |
| | Avg. | Std. | Avg. | Std. | Avg. | Std. | Avg. | Std. |
| Basis Weight - Conditioned (g/m$^2$) | 44.01 | 0.51 | 40.80 | 0.16 | 41.37 | 0.07 | 41.65 | 0.19 |
| Caliper, 1 sheet (um) | 234 | 4 | 225 | 16 | 240 | 2 | 245 | 5 |
| GMT (g/3 in) | 823 | 31 | 1145 | 33 | 938 | 35 | 978 | 23 |
| MD Tensile (g/3 in) | 1111 | 66 | 1597 | 55 | 1273 | 62 | 1340 | 29 |
| CD Tensile (g/3 in) | 610 | 9 | 820 | 18 | 692 | 18 | 713 | 18 |
| HST (sec) | 8.9 | 0.2 | 2.5 | 0.4 | 41.1 | 5.5 | 3.2 | 0.2 |
| Water Drop Absorbency Rate (sec) | 2.6 | 0.2 | 2.8 | 0.5 | 40.6 | 5.6 | 2.0 | 0.2 |

Table 1 lists the basis weight, caliper, geometric mean tensile (GMT), and the absorbent rate properties of Y-14868 silicone post-treated, 6014A post-treated (this invention) and non-post-treated prototypes. The post-treated, non-fibrous polymeric surface structure-containing basesheet prototypes (Codes 321 and 322) are softer than Codes 302 and 314.

Post treatment of the commercial basesheet (non-fibrous polymeric surface structures not present) produces a product with the absorbent rate properties shown (Code 314). Surprisingly, the absorbent rate properties are significantly worse (longer times to absorb) when the non-fibrous polymeric surface structure-containing basesheet is post treated with Y-14868 (Code 321). Compared to the corresponding, non-post-treated, non-fibrous polymeric surface structure-containing basesheet (Code 302), Y-14868 post treatment absorbent rate is about 15 times slower. The Y-14868 silicone emulsion combined with the non-fibrous polymeric surface structure-containing basesheet creates a very hydrophobic tissue.

Post treatment of 3-ply tissue containing non-fibrous polymeric surface structures (Code 302) is desired to further improve softness and differentiate the hand feel. While the softness improvements and hand feel differentiation can be accomplished with the Y-14868 post treatment, the Y-14868 post treatment unexpectedly and significantly hurts the absorbency of the sheet. Application of the 6014A formulation (softening composition) to the basesheet containing non-fibrous polymeric surface structures, however, solves this problem and enables all three properties (softness, hand feel, and absorbent rate) to be improved (Code 322).

Comparative Example 4

A 3-ply hard roll of Code US-2 from Example 1 was unwound, folded and cut into individual tissues. The folded tissues, Code US-2, were subjected to various standardized tests. The results are shown in Table 2 of Example 3.

Comparative Example 5

Three soft rolls of single-ply, creped tissue Code US-3 were plied, calendered, crimped, post treated with GE silicone Y-14868, slit, and rewound so that both creped sides were on the outside of the 3-ply structure. The 3-ply sheet was calendered between two steel rolls to a 3-ply target caliper of 280 microns. Mechanical crimping on the edges of the structure held the plies together. The Y-14868 emulsion was printed on both outer sides of the 3-ply tissue web via a simultaneous offset rotogravure printing process. The gravure rolls were electronically engraved, chrome-over-copper rolls supplied by Southern Graphics Systems, located at Louisville, Ky. The rolls had a line screen of 360 cells per lineal inch and a volume of 1.47 Billion Cubic Microns (BCM) per square inch of roll surface on one side and 1.6 BCM Billion Cubic Microns (BCM) per square inch of roll surface on the other side. The rubber backing offset applicator rolls had a 75 Shore A durometer cast polyurethane surface and were supplied by American Roller Company, located at Union Grove, Wis. The process was set up to a condition having 0.375 inch interference between the gravure rolls and the rubber backing rolls and 0.003 inch clearance between the facing rubber backing rolls. The simultaneous offset/offset gravure printer was run at 500 feet per minute. The treated, 3-ply sheet was then folded, and cut into individual tissue sheets (8.5 inches in length). This process yielded a treatment level of 2.9 weight percent based on the weight of the treated tissue. The average 3-ply basis weight of the specific US-3 rolls before treatment was 42.75 gsm. The 6014A treated tissues, Code US-3-K, were subjected to various standardized tests. The results are shown in Table 2 below.

TABLE 2

| | Example # | | | | | |
|---|---|---|---|---|---|---|
| | Comp. Ex. 4 | | Comp. Ex. 5 | | Example 3 | |
| | Code | | | | | |
| | US-2 | | US-3-Y | | US-3-K | |
| | Basesheet Additive Amount | | | | | |
| | 400 mg/m$^2$ | | 400 mg/m$^2$ | | 400 mg/m$^2$ | |
| | Post Treatment | | | | | |
| | none | | Y-14868 | | 6014A | |
| | Plies | | | | | |
| | 3 | | 3 | | 3 | |
| | Avg. | Std. | Avg. | Std. | Avg. | Std. |
| Basis Weight - Conditioned (g/m$^2$) | 43.29 | 0.14 | 44.31 | 0.24 | 43.83 | 0.51 |
| Caliper, 1 sheet (um) | 272 | 2 | 266 | 2 | 266 | 2 |
| GMT (g/3 in) | 1200 | 42 | 1235 | 25 | 1284 | 39 |
| MD Tensile (g/3 in) | 1681 | 70 | 1582 | 50 | 1671 | 47 |
| CD Tensile (g/3 in) | 857 | 25 | 964 | 9 | 986 | 32 |
| HST (sec) | 12.4 | 1.2 | 717 | 145 | 13.1 | 0.6 |
| Water Drop Absorbency Rate (sec) | 1.9 | 0.1 | 124.8 | 72.3 | 5.6 | 0.5 |

percent based on the weight of the treated tissue. The average 3-ply basis weight of the specific US-3 rolls before treatment was 43.02 gsm. The Y-14868 treated tissues, Code US-3-Y, were subjected to various standardized tests. The results are shown in Table 2 of Example 3.

Example 3

Three soft rolls of single-ply, creped tissue Code US-3 were plied, calendered, crimped, post-treated with silicone emulsion blend 6014A (softening composition), slit, and rewound so that both creped sides were on the outside of the 3-ply structure. The composition of the 6014A formulation is shown in Example 2. The 3-ply sheet was calendered between two steel rolls to a 3-ply target caliper of 280 microns. Mechanical crimping on the edges of the structure held the plies together. The 6014A formulation was printed on both outer sides of the 3-ply tissue web via a simultaneous offset rotogravure printing process. The gravure rolls were electronically engraved, chrome-over-copper rolls supplied by Southern Graphics Systems, located at Louisville, Ky. The rolls had a line screen of 360 cells per lineal inch and a volume of 1.47 Billion Cubic Microns (BCM) per square inch of roll surface on one side and 1.6 BCM Billion Cubic Microns (BCM) per square inch of roll surface on the other side. The rubber backing offset applicator rolls had a 75 Shore A durometer cast polyurethane surface and were supplied by American Roller Company, located at Union Grove, Wis. The process was set up to a condition having 0.375 inch interference between the gravure rolls and the rubber backing rolls and 0.003 inch clearance between the facing rubber backing rolls. The simultaneous offset/offset gravure printer was run at 500 feet per minute. The treated, 3-ply sheet was then folded, and cut into individual tissue sheets (8.5 inches in length). This process yielded a treatment level of 2.5 weight The three, 3-ply tissue prototypes listed in Table 2 have comparable geometric mean tensile strength and caliper. The post-treated Code US-3-K is softer than Code US-3-Y. Both US-3-K and US-3-Y have a different hand feel than Code US-2. However, the Y-14868 post-treated 3-ply tissue prototype containing non-fibrous polymeric surface structures (Code US-3-Y) has an absorbent rate that is about 60 times slower that the non-post treated code US-2. Post treatment with the 6014A formulation (this invention), by contrast, creates differentiated hand feel and a softer tissue than Code US-3-Y with the absorbency rates of the non-post treated Code US-2.

It will be appreciated that the foregoing examples and description, given for purposes of illustration, are not to be construed as limiting the scope of the invention, which is defined by the following claims and all equivalents thereto.

We claim:

1. A tissue sheet comprising non-fibrous polymeric surface structures and further comprising from about 0.2 to about 20 dry weight percent of a topically applied softening composition, said softening composition comprising, based on the total amount of actives in the composition, from about 5 to about 40 weight percent polysiloxane, from about 10 to about 50 weight percent of an fatty alkyl derivative, from about 20 to about 80 weight percent glycerin, wherein the tissue sheet has a geometric mean tensile strength of from about 600 to about 1300 grams per 3 inches.

2. The tissue sheet of claim 1 wherein the amount of the softening composition is from about 0.5 to about 10 dry weight percent.

3. The tissue sheet of claim 1 wherein the amount of the softening composition is from about 0.5 to about 5 dry weight percent.

4. The tissue sheet of claim 1 having an absorbent rate, as measured by the Water Drop Absorbency Rate, of about 40 seconds or less.

5. The tissue sheet of claim 1 having an absorbent rate, as measured by the Hercules Size Test, of from about 40 seconds or less.

6. The tissue sheet of claim 1 wherein the non-fibrous polymeric surface structures comprise a polymeric blend of an ethylene alpha-olefin copolymer and an ethylene-carboxylic acid copolymer.

7. The tissue sheet of claim 6 wherein the ethylene alpha-olefin copolymer is an ethylene and octene copolymer.

8. The tissue sheet of claim 6 wherein the ethylene-carboxylic acid copolymer is an ethylene-acrylic acid copolymer.

* * * * *